US007311683B2

(12) United States Patent
Turell et al.

(10) Patent No.: US 7,311,683 B2
(45) Date of Patent: Dec. 25, 2007

(54) SYSTEMS AND METHODS FOR PROVIDING DRY HYDROTHERAPY TO A RECLINED HUMAN SUBJECT

(76) Inventors: Gary R. Turell, 513 N. Link La., Fort Collins, CO (US) 80524; Kenneth Assink, 13395 Tyler St., Holland, MI (US) 49424

( * ) Notice: Subject to any disclaimer, the term of this patent is extended or adjusted under 35 U.S.C. 154(b) by 0 days.

(21) Appl. No.: 11/163,783

(22) Filed: Oct. 31, 2005

(65) Prior Publication Data

US 2007/0100261 A1 May 3, 2007

Related U.S. Application Data

(60) Provisional application No. 60/623,327, filed on Oct. 29, 2004.

(51) Int. Cl.
*A61H 1/00* (2006.01)

(52) U.S. Cl. ..... 601/55; 601/157

(58) Field of Classification Search ..... 601/55, 601/148–150, 156–160; 5/604, 606, 695, 5/710

See application file for complete search history.

(56) References Cited

U.S. PATENT DOCUMENTS 3,428,973 A * 2/1969 Blocker, Jr. et al. ..... 5/689
3,559,634 A * 2/1971 Lillywhite ..... 601/157
4,976,256 A * 12/1990 Marlin et al. ..... 601/55
4,976,276 A 12/1990 Marlin et al.
5,540,651 A * 7/1996 Risch et al. ..... 601/148
5,827,206 A 10/1998 Lunter
6,282,735 B1 * 9/2001 Stolpmann et al. ..... 5/606
6,913,572 B2 * 7/2005 Licht et al. ..... 600/27

* cited by examiner

*Primary Examiner*—Michael A. Brown
(74) *Attorney, Agent, or Firm*—Ancel W. Lewis, Jr.

(57) ABSTRACT

Systems and methods for providing dry hydrotherapy to a reclined human subject in a home or commercial environment. The systems include an enclosed tub with an external support frame and an internal operational frame. The enclosed tub includes a multi-layer cover upon which the human subject may recline to receive the hydrotherapy. The cover includes an open netting layer attached to a perimeter edge of the tub for supporting the weight of the user and a pliable waterproof layer positioned over the netting for containing the liquid used in the hydrotherapy while still transferring the massaging force of the liquid to the user. The liquid is directed under pressure against the underside of the cover with a moveable liquid jet source positioned on a track within the tub. A liquid circulation system cycles the liquid through the tub enclosure in the process of providing the dry hydrotherapy. A sleep system includes a selectively inflated air mattress. A built-in system is installed in the plumbing and electric lines and in place of the conventional tub.

24 Claims, 17 Drawing Sheets

SYSTEMS AND METHODS FOR PROVIDING DRY HYDROTHERAPY TO A RECLINED HUMAN SUBJECT

RELATED APPLICATION

This application claims the benefit under 35 USC §119 (E) of U.S. Provisional Patent Application Ser. No.: 60/623,327 filed Oct. 29, 2004, entitled "DRY WAVE SPA APPARATUS AND METHODS". By this reference, the entire disclosure of said U.S. Provisional patent Application is incorporated herein.

BACKGROUND OF THE INVENTION

1. Field of the Invention

The present invention relates generally to massage therapy systems and methods. The present invention relates more specifically to systems and methods for stimulating circulation and lymphatic flow and for supporting, massaging, relaxing and soothing the body of a reclined human subject through the provision of dry hydrotherapy. The invention further relates to systems and methods for supporting a human subject and containing and controlling fluids for the delivery of dry hydrotherapy to the subject.

2. Description of the Related Art

Massage therapy has been in use for many years to relax muscles, soothe pain, manage stress, increase circulation and promote lymphatic flow. The term "dry hydrotherapy" has been used in the industry to describe the use of water for the purpose of massage therapy without resulting in the individual getting wet. There have been various efforts in the industry to design systems for dry hydrotherapy products. These products take on various configurations ranging from chairs to standard twin-bed-sized designs and beds with overhead enclosures. Examples of dry hydrotherapy products that have previously been developed include those described in U.S. Pat. No. 4,976,256 issued to Marlin et al., entitled Body Massage Apparatus, and U.S. Pat. No. 5,827,206 issued to Lunter (assigned to JTL Enterprises), entitled Dry Hydromassage Chair. In addition, Wellsystem GmbH, of Windhagen, Germany, markets bed style dry hydrotherapy products under the Wellsystem™ trademark (referenced on the Internet at www.wellsystem.com). There are a number of additional products available in the hydrotherapy market including products marketed by Aqua Massage International, Inc., of Groton, Conn. under the Aqua Massage™ & Aqua PT™ trademarks (referenced on the Internet at www.amiaqua.com), products marketed by SpaBed Dry Hydro Massage Systems, of Kenosha, Wis. under the DrySpa™, EuroWave™ and Thermassage™ trademarks (referenced on the Internet at www.spabed.com), products marketed by BackMan Products, Inc. of Boise, Id. under the Aqua-jet Power Massage Table™ trademark (referenced on the Internet at www.komkare.com), and products marketed by Sidmar Mfg, Inc., of Princeton, Minn. under the Sidmar Classic Hydrotherapy Table™ trademark (referenced on the Internet at www.sidmar.com).

Though some dry hydrotherapy units have experienced commercial success, there has long been a need for improved dry hydrotherapy systems and methods. Especially needed are dry hydrotherapy systems and methods that are simple in design, affordable to make and maintain, and efficient in their energy requirements as well as in the amount of space that they occupy in use. There is also a long-felt need to provide dry hydrotherapy systems that are safer and more effective in delivering massage therapy to subjects in the home environment.

SUMMARY OF THE INVENTION

An object of the present invention is therefore to enable such improved dry hydrotherapy and to provide dry hydrotherapy units that are simple, safe, affordable, and effective to human subjects.

A further object includes the provision of dry hydrotherapy units that are capable of overcoming historical size and cost barriers to entry in the dry hydrotherapy market, and the provision of stand-alone, home configured, dry hydrotherapy units.

Still further objects of the present invention will be evident to those of skill in the art form a review of the prior art and from a review of the foregoing and following descriptions, particularly when considered together with the accompanying figures and claims.

In accordance with the foregoing objectives, the present invention generally comprises improved systems and methods for delivering dry hydrotherapy to human subjects. Accordingly, the present invention is directed to devices and methods that are simple, safe, affordable, and effective in delivering dry hydrotherapy.

The improved system is designed to achieve maximum massage effect with minimum electrical consumption. The components required for the design operate at less than 15 amps of electrical current and still deliver a high-pressure massage. The improved apparatus utilizes a unique pumping system combined with minimal plumbing travel distance and a specially designed water jet manifold.

A rugged and durable jet track system has been designed with a track and roller system that virtually eliminates jamming or sticking of track. The roller design has rollers that glide on two round track bars from three directions.

The hand-controller allows for the user to select from a number of customized zone based pressure controls while lying on the bed. This enables the user to identify different pressure levels for specific parts of the body (i.e. higher pressure for shoulders to waist, medium pressure for leg area and low pressure for head area). The hand-controller includes an LCD screen, power control, speed control, pressure control, temperature control, a reset to a previous setting, and the setting of upper and lower limits of the massage elements.

The apparatus of the present invention is designed to accommodate varying body lengths (or massage zones) and different massage needs. The upper and lower limits set the location area of massage. When lying on the bed, the user may set the upper body stopping point for the jet. When the jet moves down the body, the user may set the lower body stopping point for the jet.

The systems and methods of the present invention therefore provide dry hydrotherapy to a reclined human subject in a home environment. The system includes an enclosed tub with an external support frame and an internal operational frame. The enclosed tub includes a multi-layer interface upon which the human subject may recline to receive the hydrotherapy. The interface includes a weight-bearing layer, preferably in the form of an open mesh, and a pliable waterproof layer for containing the liquid used in the hydrotherapy. Most preferably, the interface also includes a cushioned body mask, providing added comfort while still transferring the massaging force of the liquid to the user, as well as an inflatable sleep surface. The sleep surface is integrated atop the hydrotherapy unit to provide even greater comfort when therapy is either inactive or less critical, and its inflatable character allows it to be selectively deflated so that the patient can be lowered directly against the waterproof layer. A unified control system alternately controls the system so that it provides alternating periods of cushioned support and hydrotherapy massage at periodic or scheduled intervals.

The liquid is directed under pressure against the underside of the waterproof layer with a moveable liquid jet source positioned on a track within the tub. A liquid circulation system cycles the liquid through the tub enclosure in the process of providing the dry hydrotherapy, and improved heating, plumbing and related systems provide an overall system that is far improved over the prior art.

Many other objects, features and advantages of the invention will be evident to those of skill in the art from the following more detailed descriptions of preferred embodiments, particularly when considered by those who have an understanding of the dry hydrotherapy systems that are commercially available and the various other teachings of the prior art. The various features of novelty that characterise the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
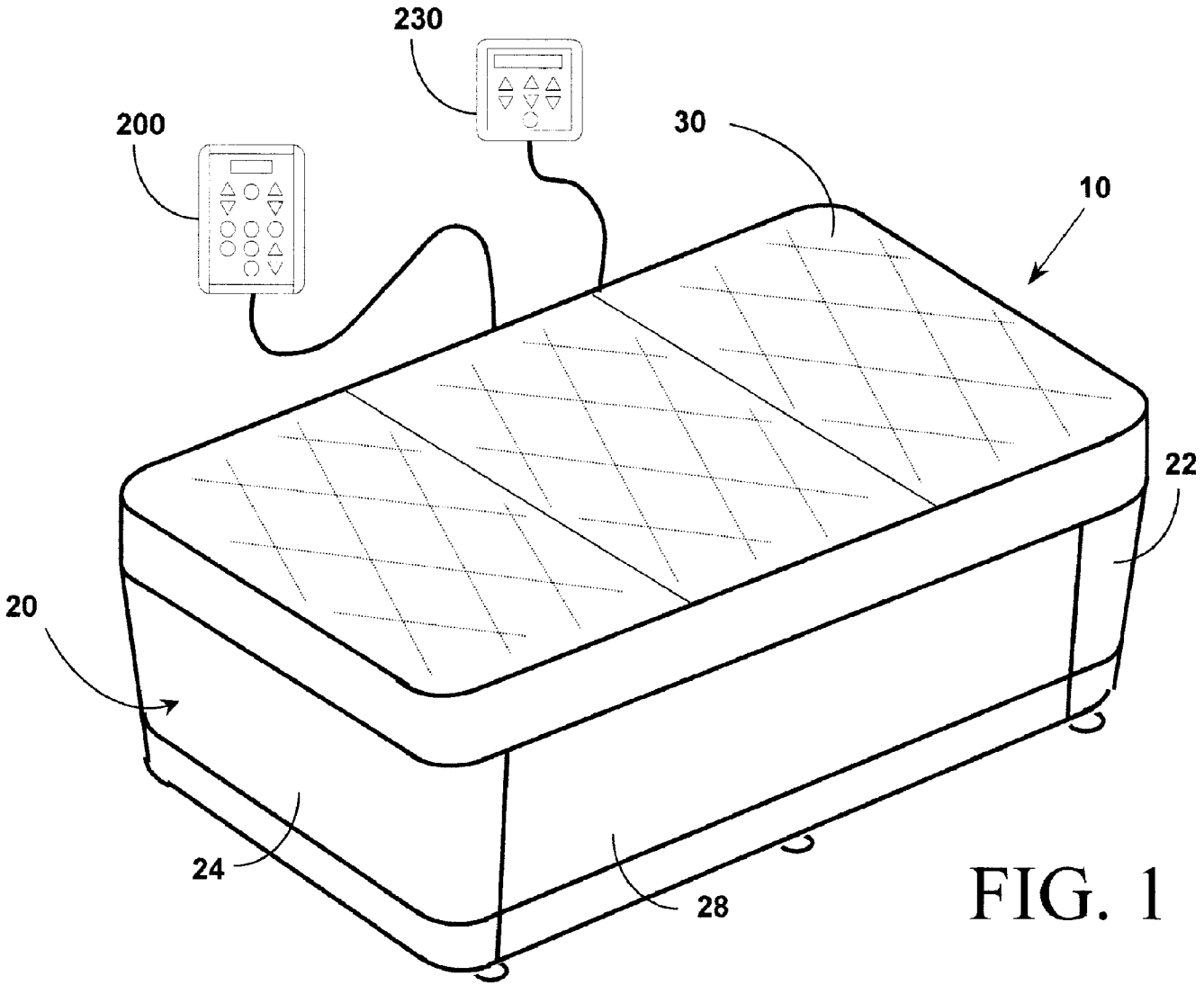
FIG. 1 is a perspective view of the preferred dry hydrotherapy sleep system 10 of the present invention in its assembled and enclosed configuration.

Reference is made first to the bird's eye perspective view of FIG. 1 for a brief summary of the overall external structure and appearance of dry hydrotherapy sleep system 10, which is a representative of the preferred embodiment of the present invention. Dry hydrotherapy sleep system 10 is comprised primarily of a sleep system subassembly 30 mounted atop core hydrotherapy subassembly 20. Coupled together in the operative configuration shown in FIG. 1, the two subassemblies to provide a generally twin bed sized platform for supporting a single human user on the top surface thereof. Also seen in FIG. 1 are a hydrotherapy user control unit 200 and a sleep system user control 230 connected to the internal controllers of the system 10 in a manner described in more detail below. Although the two hand-held control units 200 and 230 may be united into a single, unified hand-held control as in alternative described herein, there are two hand-held control units 200 and 230 in the embodiment of FIG. 1. The user control unit 200 provides the user with the ability to control the operational characteristics of the hydrotherapy subassembly 20 while in use, and the sleep system control unit 230 provides the user with the ability to control the operational characteristics of the sleep system subassembly 30 while in use.

Figure 1A:
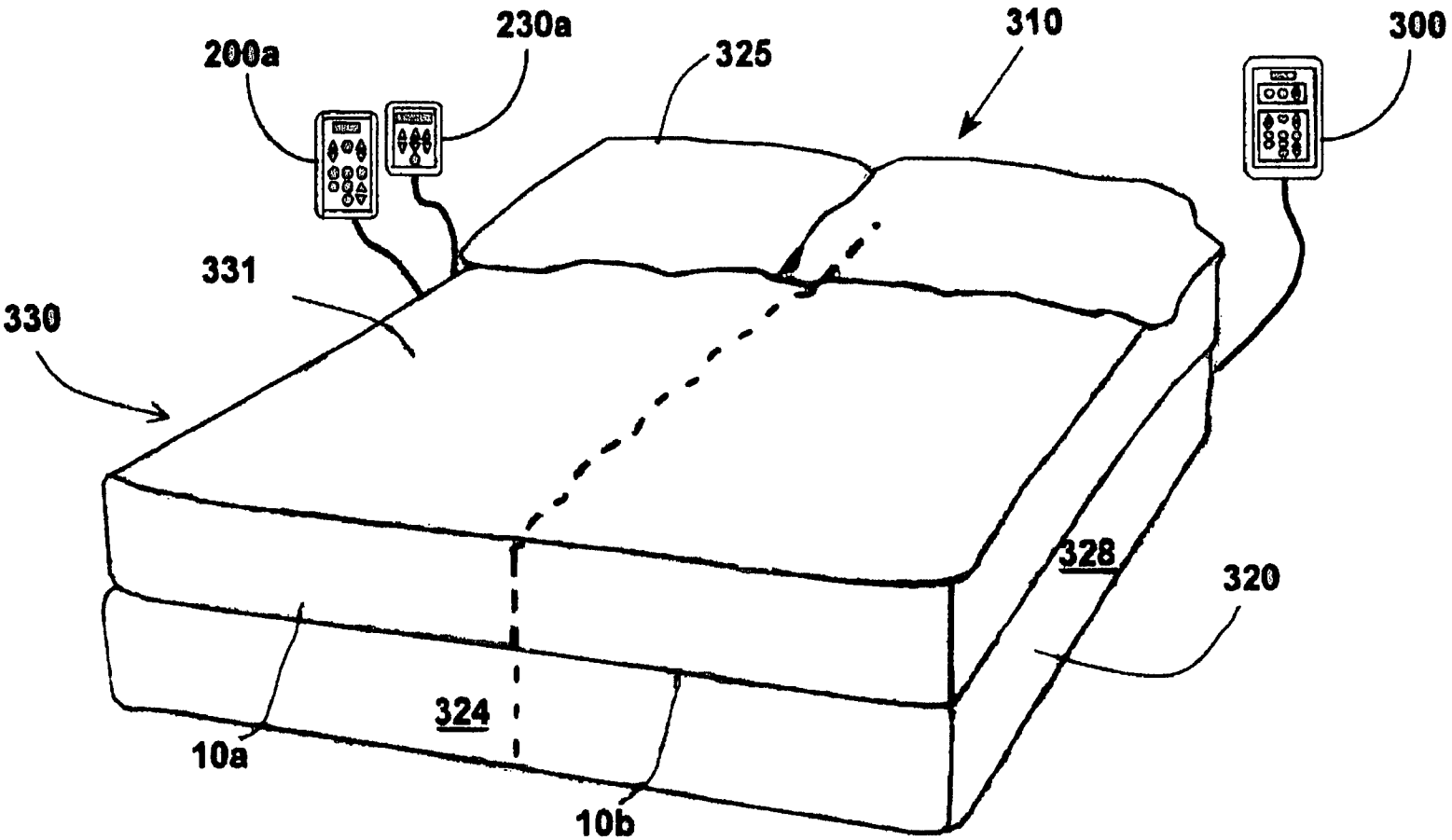
FIG. 1A shows a perspective view of a first alternative embodiment in its assembled and enclosed configuration, namely the dry hydrotherapy sleep system 310, which is adapted for supporting two patients on a single surface, with independent controls.
Figure 1B:
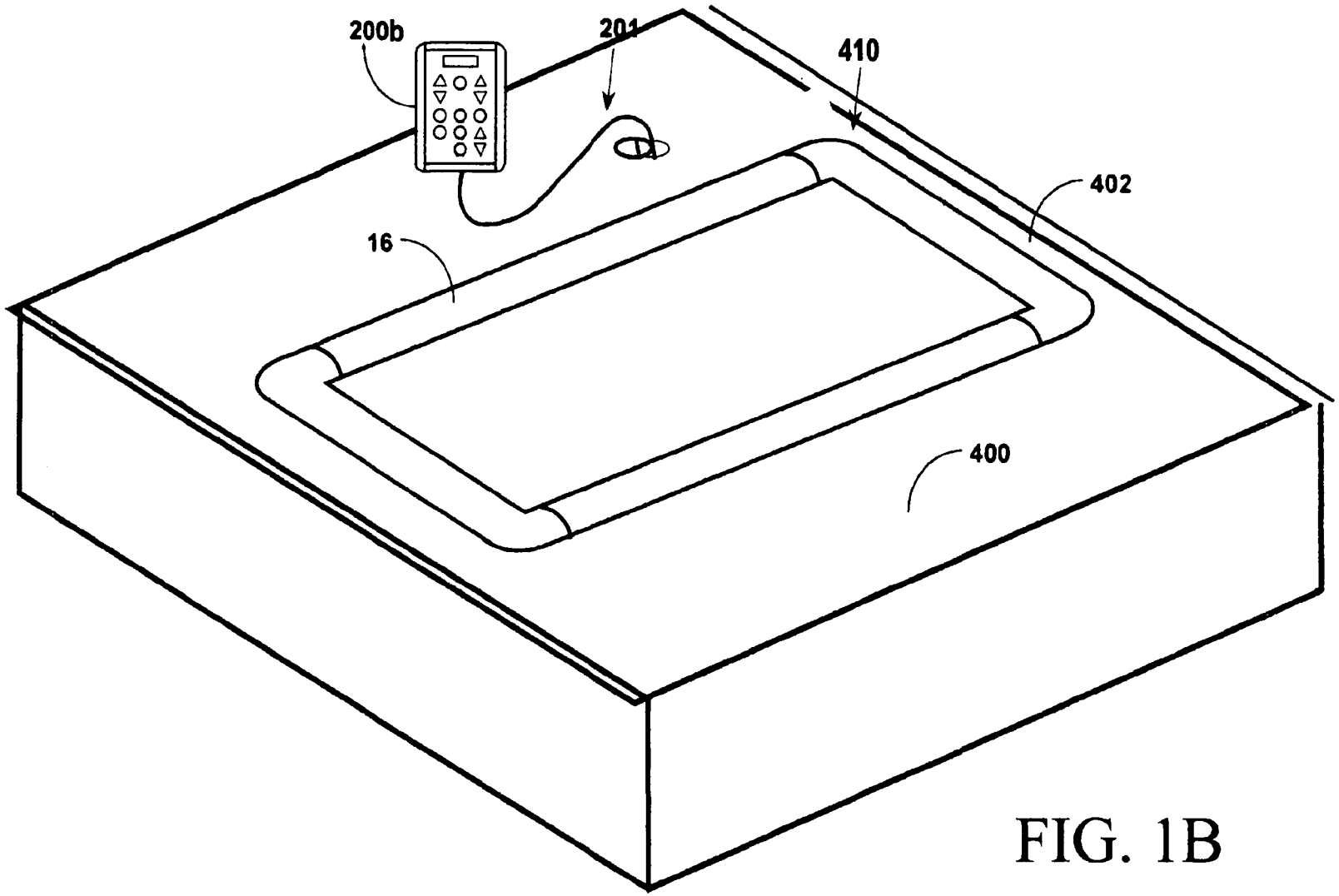
FIG. 1B shows a perspective view of a second alternative embodiment in its assembled and enclosed configuration, namely the built-in hydrotherapy 200*b*, which is adapted for providing dry hydrotherapy in a unit integrated into surrounding household structures.

As will be evident to those of skill in the art, various alternative embodiments to hydrotherapy sleep system 10 may also fall in the scope of the present invention. FIG. 1A, for instance, shows a first alternative embodiment in the form of dry hydrotherapy sleep system 310 (described further herein) which is adapted for simultaneous use by two users, such as a husband and wife, to provide a hydrotherapy sleep surface of the present invention for the benefit of both such users. FIG. 1B, as another example, shows a second alternative embodiment 200*b* adapted for integration into surround household structures.

With reference again to the embodiment of hydrotherapy sleep system 10 of FIG. 1, the hydrotherapy subassembly 20 is preferably enclosed within an array of panels and bolsters that provide both comfort and safety to the user, as well as providing an attractive "package" suitable for placement of the system within the home environment. These panels and bolster include tow end-edge cap cushion bolsters 12 and 14 along with side-edge cap cushion bolsters 16 and 18. End panels 22 and 24 enclose the major portion of the smaller end sections of the hydrotherapy subassembly 20 while side panels 26 (not shown in FIG. 1) and 28 cover the longitudinal sides of the generally twin bed sized platform of the hydrotherapy subassembly 20.

Figure 2:
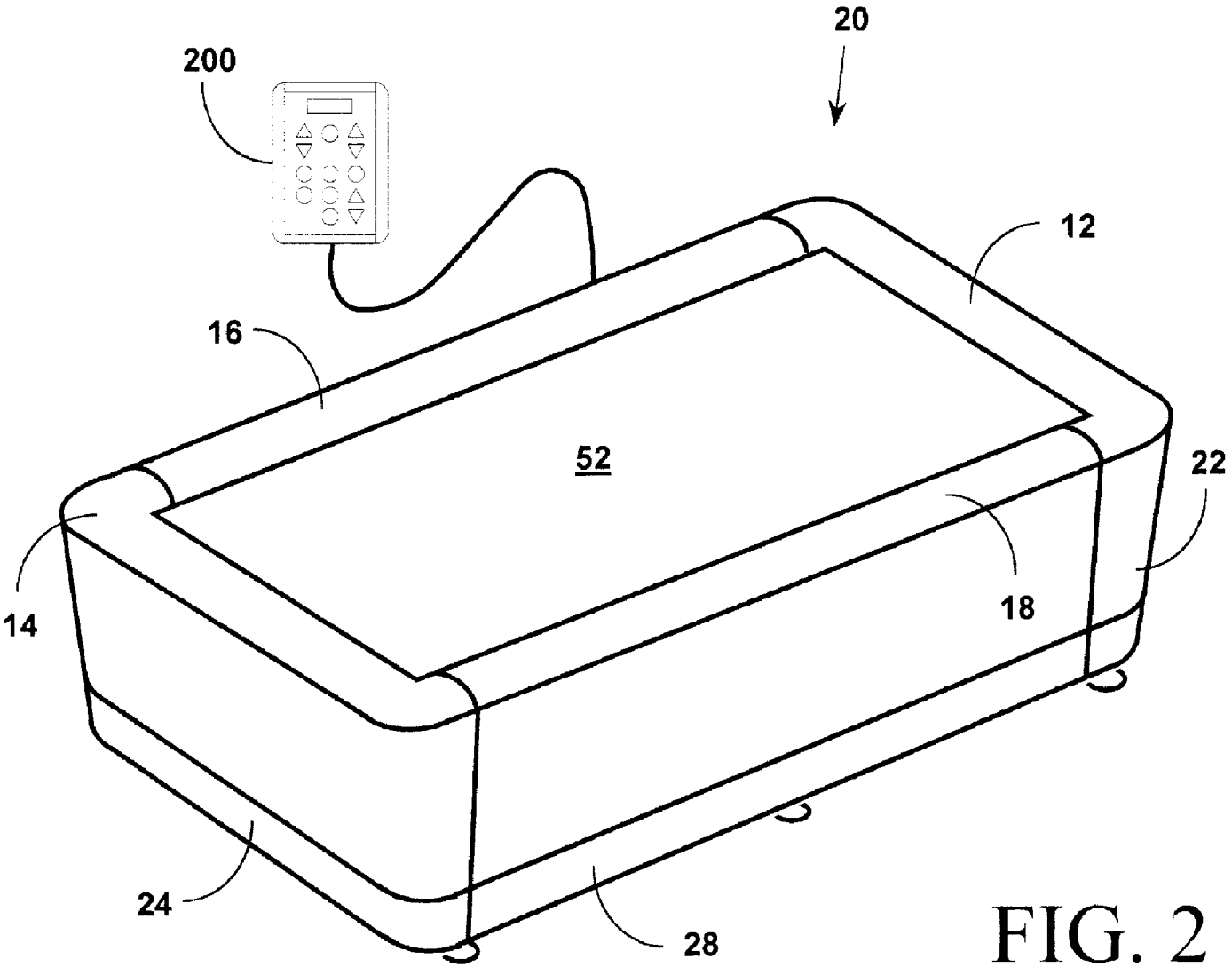
FIG. 2 is a perspective view of the dry hydrotherapy subassembly 20 of the preferred dry hydrotherapy sleep system 10 of the present invention, showing much the same view as FIG. 1 except that the sleep surface 30 is omitted.
Figure 3:
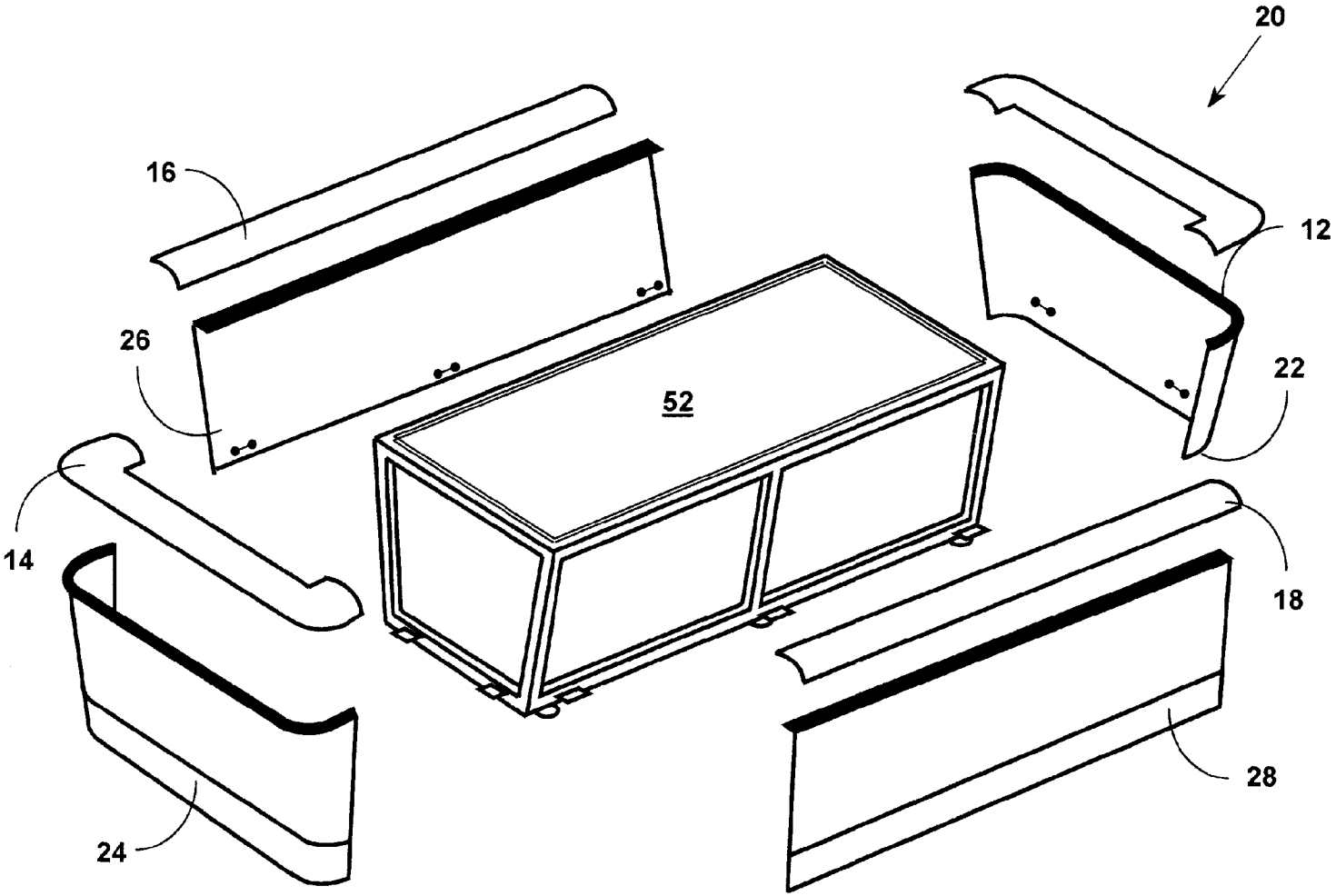
FIG. 3 is an exploded perspective view showing the exterior panel components of the system of the present invention and their manner of removal from the hydrotherapy subassembly.

Referring now to FIG. 2, the assembly of the various component panels and bolsters is disclosed in more detail. The hydrotherapy subassembly 20 of the preferred embodiment is shown in FIG. 3 with the various bolsters, side panels, and end panels removed. The methodology associated with the use of the system of the present invention to utilize easily removable and replaceable panels and bolsters. As described in more detail below, the user is provided access to the interior of the system for the purpose of initially setting the system up and thereafter maintaining the quality of the water within the system over time. In the preferred embodiment therefore, each of the side panels 26 and 28 would be constructed with a rigid fiber material panel, covered over with a softer cushion or foam material that is finally covered with a vinyl or other durable waterproof fabric material. End panels 22 and 24 would be similarly constructed of a rigid fiber material panel (in this case, with curved sides) that would likewise be covered on at least and exterior face with cushion or foams material and an outer layer of vinyl or other waterproof fabric material. This construction for the panels provides the necessary rigidity and a high degree of noise suppression and thermal insulation. The construction also lends itself to economically adhering custom colored vinyl or fabric to the exterior without the need for a secondary sewing or covering operation.

Each of the side panels and end panels may be secured to the central hydrotherapy subassembly 20 by means of clips positioned along the bottom edge of the frame comprising the hydrotherapy subassembly and by hook and loop fastener surfaces positioned along the top perimeter edge of the frame of the hydrotherapy subassembly.

After the side and end panels are positioned and secured to the hydrotherapy subassembly, the edge cap cushion bolsters 12, 14, 16, and 18 are then positioned on the top, flat, edge surfaces of the panels assembled as described above. In addition to the side and end panels being secured to the central hydrotherapy subassembly 20 by means of hook and loop fastener surfaces, the edge cap cushion bolsters may likewise be positioned and secured to the tops of the side and end panels by way of hook and loop fastener surfaces. As with the side and end panels, the edge cap cushion bolsters would likewise be constructed with a rigid interior fiber panel, covered on at least one side by a cushion or foam layer and then covered over by a vinyl or other waterproof fabric material.

As shown in FIG. 1, system 10 preferably includes an overlying sleep system 30, shaped and sized to fit snugly over the core hydrotherapy assembly 20 once the panels and bolsters have been positioned and secured. As with the side and end panels, the overlying sleep surface 30 may be provided with either softer cushion material covered with a durable fabric, or simply with a thick durable fabric material. The resulting hydrotherapy sleep system 10 combines the function of a dry hydrotherapy system 20 with the comfort and convenience of an air chambered sleeping mattress 32.

Figure 4:
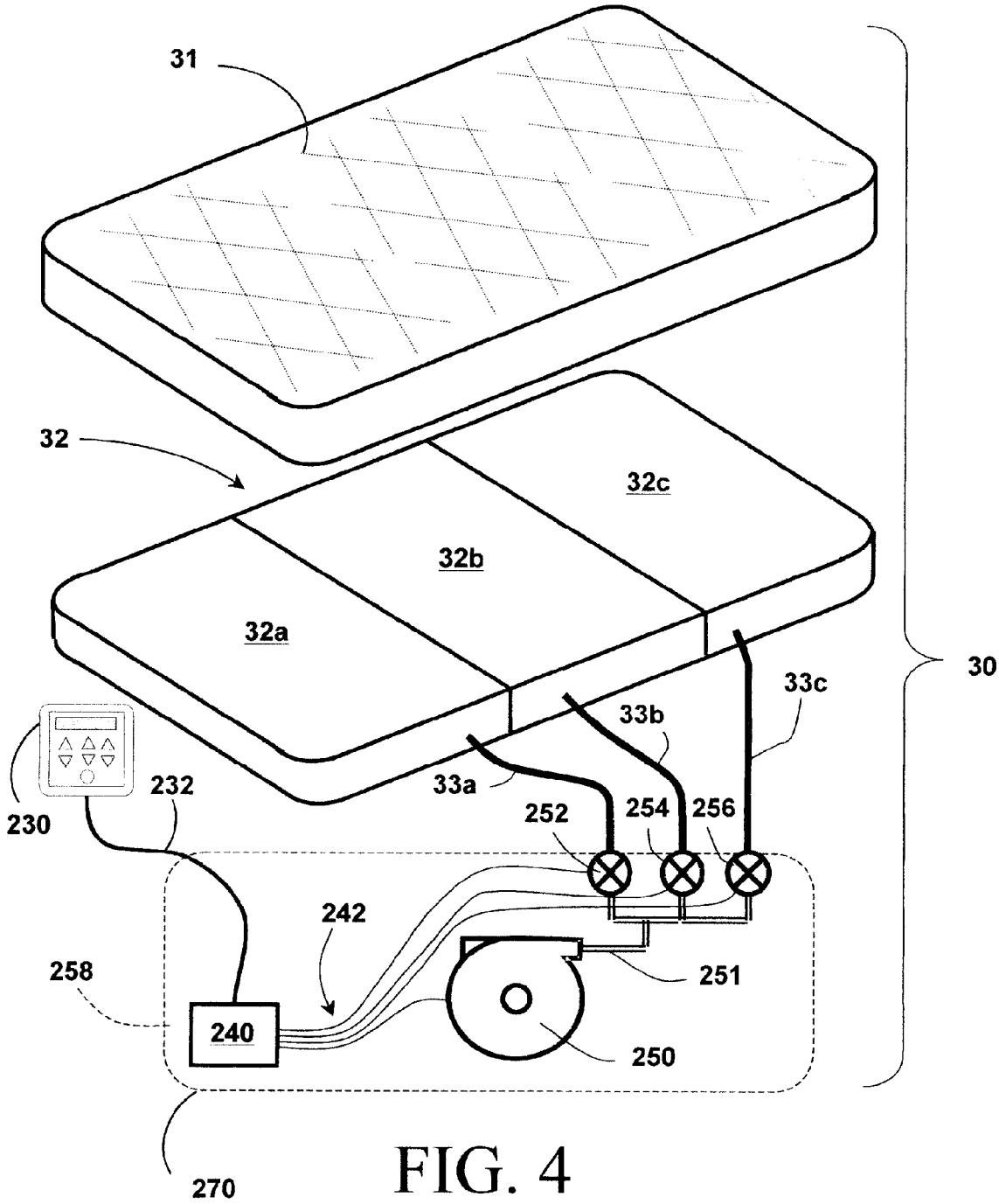
FIG. 4 is an exploded perspective view (layers vertically separated) of the components of the sleep surface 30 of the preferred embodiment.

With reference to FIG. 4 the overlying sleep system 30 generally includes an inflatable mattress 32, a sleep cover 31, inflation control unit 258, and hand-held control 230. Inflation control unit 258 is housed in a plastic case with air conduits 33*a*-33*c* extending from the housing case to the mattress 32. The air conduits 33*a*-33*c* preferably correspond in quantity to the number of zones of independent pressure control in the air mattress 32. Mattress 32 of the preferred embodiment has three such zones- zones 32*a*, 32*b*, and 32*c*- that are separately inflatable and generally correspond to the feet, seat and upper torso of a user lying thereon. Using hand control 230, the level of inflation of each zone or section 32*a* to 32*c* can be separately controlled to adapt to user's individual comfort preferences and physique. The inflation levels in turn are controlled by the three corresponding inflation control valves 252, 254, and 256 within the inflation control unit 258. As will be understood by those of skill in the art, hand control 230 is connected to inflation controller 240 by insulated line 232. Controller 240, in turn, is electrically connected to air mover 250 and inflation control valves 252, 254, and 256 through control lines 242. Although other connectors may be used, in the preferred embodiment, the sleep cover 31 secures the inflatable mattress subassembly 32 on top of the top surface 52 of the hydrotherapy subassembly 20.

Controller 240 is also adapted to selectively provide signals to air mover 250 and valves 252, 254 and 256 for effecting a gently pulsation of the inflation levels of mattress section 32*a*-32*c*; such pulsation (or "passive massage") is achieved by cyclically and automatically raising and lowering the inflation settings of alternate mattress sections (or smaller air cells when mattress 32 is so adapted in alternative embodiments) to redistribute the pressure points supporting the user's body. Lower pressures may enhance better sleep.

With system 10, the user may choose to utilize the hydrotherapy subassembly 20 at any time with the push of a button on a unified control such as control 300(depicted in FIG. 1A). Preferably, the controls of the system 10 keep sleep system 30 always in an inflated position as default until the user selects the control buttons to receive hydrotherapy from subassembly 20 (without interference from sleep system 30). By activating this function, the air chambered mattress 32 will automatically deflate, allowing the user's body to be supported by the suspension net 44 of hydrotherapy subassembly 20. Once mattress 32 is deflated, the hydrotherapy subassembly 20 will begin operation until the desired duration of the hydrotherapy session has ended. When the hydrotherapy session is ended, the air mattress 32 is controlled by controller 240 to re-inflate the previous inflation settings determined by the user.

Finally shown in FIG. 4, there is an overlying sleep system 30, shaped and sized to fit snugly over the core hydrotherapy assembly 20 once the panels and bolsters have been positioned and secured. As with the side and end panels, the overlying sleep surface 30 may be provided with either softer cushion material covered with a durable fabric, or simply with a thick durable fabric material.

Figure 5:
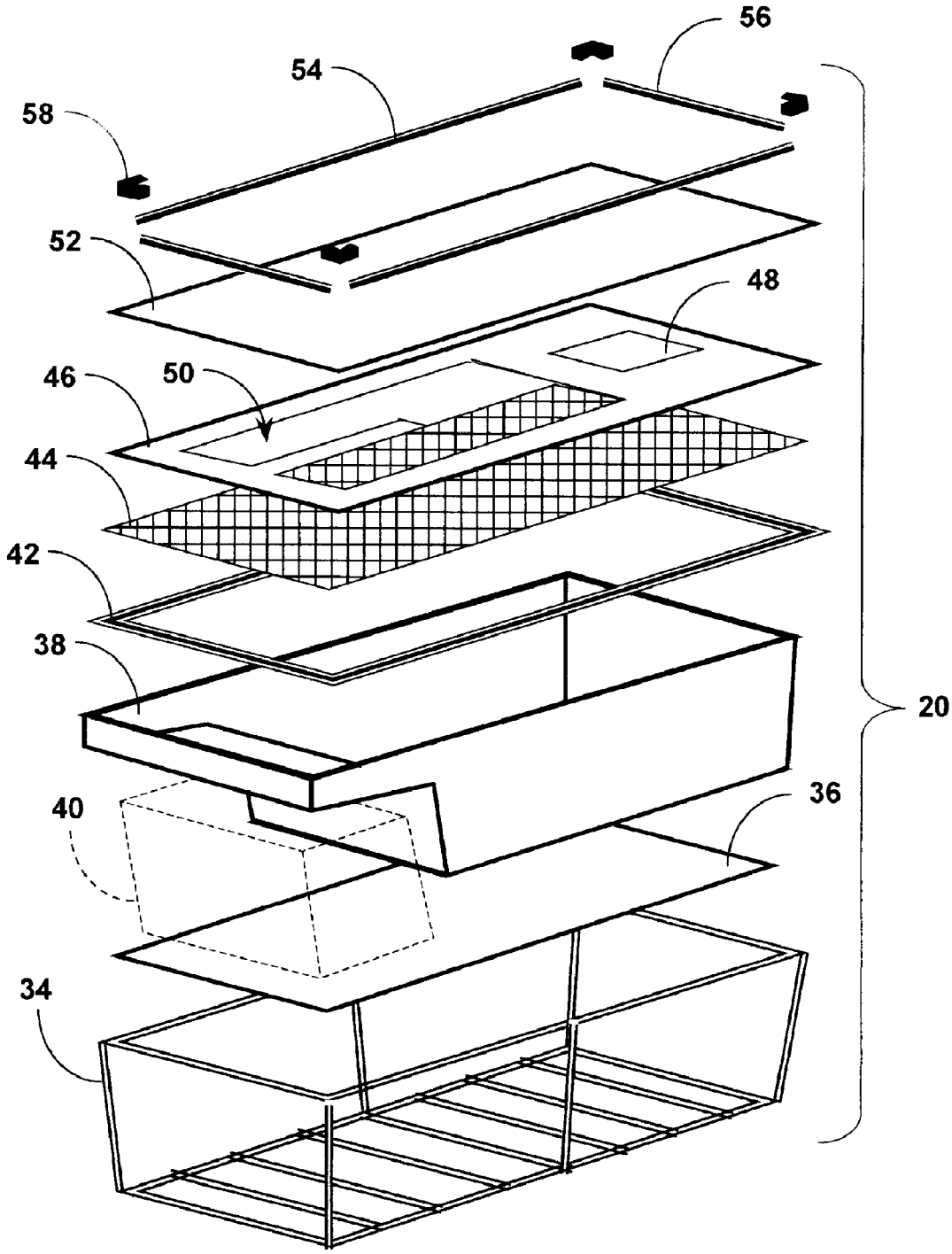
FIG. 5 is an exploded perspective view (layers vertically separated) of the hydrotherapy subassembly 20 of the preferred embodiment.

With reference to FIG. 5 for a more detailed description of the layered components that make up the hydrotherapy subassembly 20 of the system of the preferred embodiment. Hydrotherapy subassembly 20 is shown in a vertically exploded view in FIG. 5 disclosing each of the various layers that go into the construction of the system of the preferred embodiment. Omitted from FIG. 5 are the interior functional elements of the system that will be described in greater detail below. For clarity, only the larger frame and layers of the system of the preferred embodiment are disclosed in FIG. 5.

Hydrotherapy subassembly 20 of the system of the preferred embodiment is built upon a rectangular skeletal base frame 34 as shown. In the preferred embodiment, base frame 34 is constructed of square cross-section extruded aluminum tubing which provides the necessary rigidity and strength to contain the components of the system, while at the same time providing a light weight material that does not unnecessarily add to the overall weight of the structure. The base frame 34 is preferably constructed with rectangular upper and lower perimeters with a plurality of post elements connecting the two rectangular components. The lower frame perimeter incorporates a number of cross struts 78 to provide the necessary rigid base for the frame and to evenly distribute the support required for the system when it is in use (particularly when filled with water). The upper rectangular perimeter is open so as to receive and retain the remaining elements and layers of the system.

Base platform 36 is a rigid or semi rigid rectangular panel that is sized to fit within the confines of the lower frame perimeter of base frame 34. Base platform 36 may be secured to base frame 34 by any of a number of attachment means well known in the art. In the preferred embodiment, an access door may be provided in base platform 36 to allow for the removal, replacement, or repair of the heater element that is positioned between the tub (described below) and base platform 36.

On top of base platform 36 is generally positioned waterproof tub 38 (with accommodations made for the heater element as described in more detail below). Tub 38 comprises a unitary molded plastic enclosure, open on the top and forming a closed tub on the bottom and sides. As shown in FIG. 5, one end portion (the "head end" from the user's standpoint) of the otherwise rectangular tub is configured into a shallow section to allow for the various functional components of the system of the preferred embodiment to be positioned beneath tub 38 on top of base platform 36 within base frame 34. These functional components generally occupy space 40 shown in FIG. 3 and will be described in more detail below.

Positioned on top of tub 38 and attached to the upper perimeter of base frame 34 is upper frame 42. Upper frame 42, the structure of which is described and shown in more detail below, serves a number of purposes in the structure and function of the preferred embodiment. In addition to securing tub 38 within base frame 34, upper frame 42 provides an array of attachment points for support netting 44 in a manner described in more detail below. Support netting 44 is stretched across upper frame 42 with a tension and strength sufficient to provide the support necessary to hold the entire weight of the user of the system In various embodiments, secondary support materials either in addition to, or instead of air mattress 32 may also be used. For instance, in the preferred embodiment barrier cushion mask 46 includes a thin layer of foam for added cushioning when mattress 32 is deflated. Barrier cushion mask 46 is positioned and secured over support netting 44 and serves the dual purpose of providing a softer cushion area for the user of the barrier cushion mask 46 which serves the dual purpose of providing a softer cushion area for the user of the system to recline on and of masking those portions of the support surface that are not intended to transmit the dry hydrotherapy forces. Mask opening 50 is configured to allow the dry hydrotherapy forces to be felt by the arms, legs and torso of the user of the system while masking the balance of the support surface from the hydrotherapy forces. In addition to the area of material that barrier cushion mask 46 comprises, pillow cushion 48 may be positioned as indicated to provide additional support and comfort to the head of the user of the system.

Overlaying barrier cushion mask 46 and support netting 44 is waterproof surface barrier 52. In the preferred embodiment, barrier 52 is constructed of a thick polyurethane sheet with appropriate addition of more durable perimeter materials making the barrier 52 more durable for sealing and closure that allow it to be attached to a perimeter ridge on upper frame 42 in a manner described in more detail below. The attachment of waterproof surface barrier 52 is accomplished by way of the array of channel clamp seals 54 and 56 and corner clamp seals 58. These clamp seals are semi-rigid plastic channels that press over portions of waterproof surface barrier 52 and secure it to the perimeter ridge on upper frame 42, again as described in more detail below.

Figure 6:
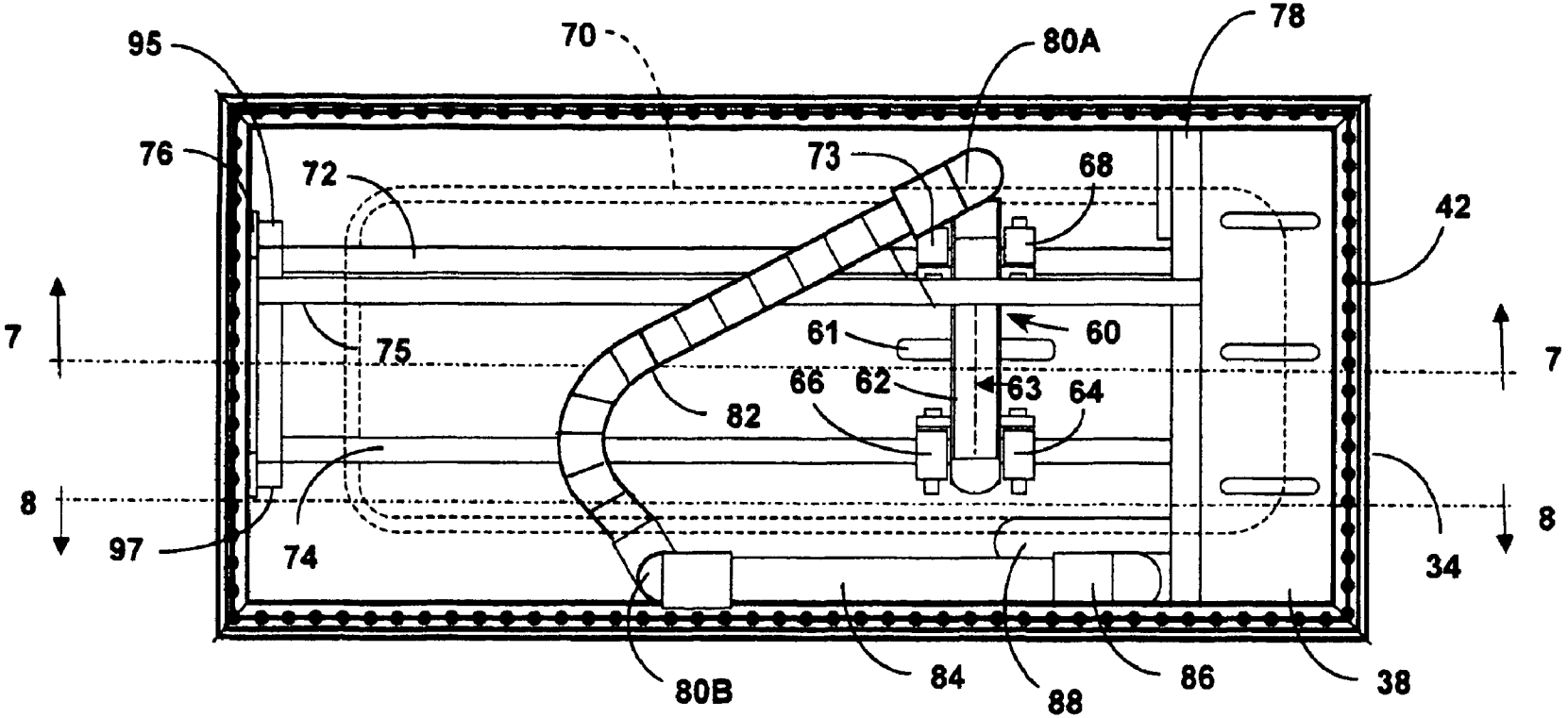
FIG. 6 is a top plan view of the interior of the hydrotherapy subassembly of the system of the preferred embodiment with the upper interface layers of the system removed.

Reference is now made to FIG. 6 for an initial description of the primary functional components of the system of the preferred embodiment. FIG. 6 is a top plan view of the hydrotherapy subassembly 20 of the system 10 shown with the various top layers removed for clarity. For reference, support netting 44, barrier cushion mask 46, and waterproof surface barrier 52, as well as channel clamp seals 54 and 56 have all been removed in the view shown in FIG. 6. This leaves the upper perimeter edge of hydrotherapy subassembly 20 comprising upper frame 42 and the upper perimeter of base frame 34. Tub 38 is viewed into its interior from this top plan view. The tub volume comprises the major portion of the tub in this view. The shallower section (to the head of the user) described above is seen above the operational component side of the tub enclosure.

Figure 15:
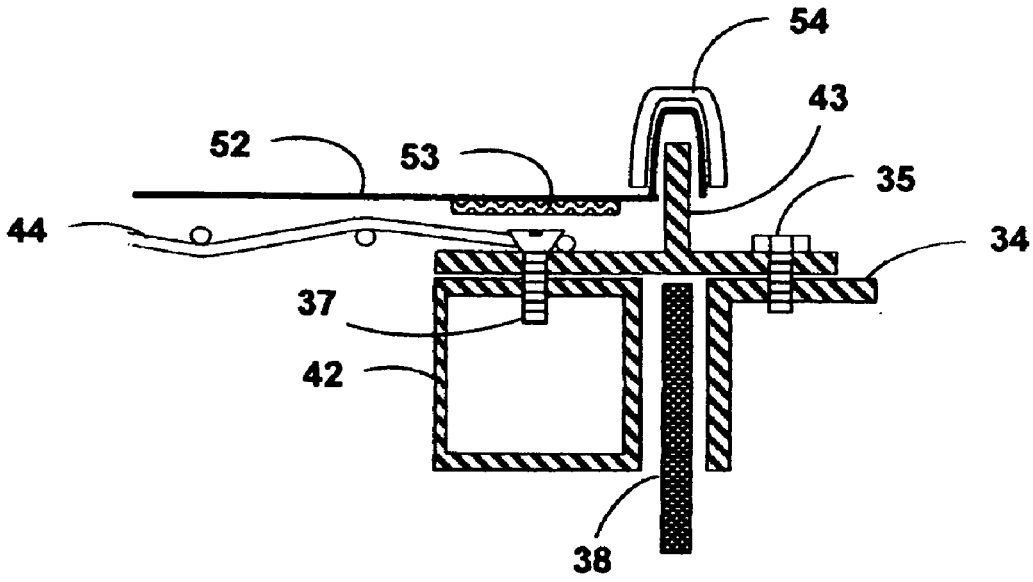
FIG. 15 is a detailed cross-sectional view of the perimeter edge of the hydrotherapy subassembly of the system of the preferred embodiment showing the manner of attachment for the elements shown in FIG. 14.

The various functional components of the invention that are positioned within the interior of tub 38 are generally held suspended at a variety of points from internal frame elements that are secured to, or are integral with, upper frame 42 (see FIG. 15 for more detail on this construction). Cross strut 78, for example, in the preferred embodiment is a square cross-section length of extruded aluminum tubing that positions and supports two vertical risers (not seen in this view) suspended beneath it. Likewise, two vertical risers 95 and 97 (the tops of which are visible in this view) are attached at an opposite end of tub 38 in a manner generally parallel to the vertical risers below strut 78. Weld plates 76 extend down from their attachment to upper frame 42 (seen best in FIG. 8) to attach to and suspend vertical risers 95 and 97.

The dry hydrotherapy system of the present invention operates by directing fan shaped jets of high pressure water up from a moving water jet assembly to the underside of the sealed, layered top barrier of the hydrotherapy subassembly platform of the system. High-pressure water is provided to the water jet assembly by the plumbing system of conduits shown in FIG. 6. This closed-loop water circulation system involves a pump and valve assembly described in more detail below, external to the tub 38. Water from the pump passes through water inlet couplers 86 from the outside of tub 38 to the interior space of the tub enclosure. Water feed pipe 84 extends from water inlet couplers 86 to a point about midway along the length of tub enclosure 38 along its upper edge. From this point, a length of flexible conduit 82 extends to a pivoting right angle coupling 80A which feeds the high pressure water to the water jet carriage assembly 60. The high pressure water passes into the jet manifold 62, which is positioned in the movable carriage 60, and from there is directed out of the manifold 62 through an array of slits 63 to impinge upon the underside of the waterproof barrier 52 covering the tub enclosure.

The tub 38 contains a liquid typically water to establish a liquid level that is below the discharge orifices or slits 63 so that the liquid passes from the manifold 62 through air and not water before impinging on the cover or barrier 52.

From the underside of the barrier 52 the water drops down to the bottom of the tub enclosure where it is drawn into return pipe 88 in a manner described in more detail below. Track wheels 64, 66, and 68, as well as additional wheels not shown in this view, facilitate the low friction movement of the carriage assembly 60 across the length of the tub enclosure space 24. These wheels travel across a parallel rail track comprised of tubular rails 72 and 74 that extend from points of attachment to the vertical risers 95 and 97 on one end of the tub 38 to the parallel vertical risers (not shown) at the opposite end of the tub enclosure. In the preferred embodiment, these round cross-section tubular rails are extruded aluminum that has been electro-coated to resist corrosion (since the rails will generally be submerged during operation of the system). The specific structures associated with the elements of the water jet carriage assembly 60 are described in more detail below in connection with FIG. 16.

Also seen in FIG. 6 are three additional elements that serve important functions in the system of the present invention. Part of the ability of the present system to provide a variable method of therapy is the use of a sensor system to locate the position of the water jet carriage assembly 60. One component of this sensor system is shown as position indicator 65 attached to the underside of the carriage assembly 60. At either end of this tubular structure is a permanent magnet of sufficient strength to trip a magnetic switch (not shown) positioned at either end of the tub 38 external to the tub wall. In this manner, an electronic indication of the position of the carriage can be acquired without the need for electrical connections within the wet confines of the tub enclosure. Also shown in FIG. 6 (in dashed outline form) is an approximate trace of the location of the heater element 70 for the system of the preferred embodiment. For clarity, this trace on the bottom of tub 38 is shown as a simple loop electrical current resistance-heating element (of the type used to heat spas, water beds and the like) positioned between the bottom of the tub and the top of base platform 36. In the preferred embodiment the structure of this heating element 70 might be more circuitous in order to increase the exposure of the element to the water contained in the bottom of the tub. Finally in FIG. 6, an additional tubular aluminum bar support rail 75 extends the length of the tub enclosure generally parallel to, but positioned above the parallel rails 74 that form the carriage track. This swivel hose support rail 73 serves to help support flexible conduit 82 and maintain it out of the way of water jet carriage assembly 60. The combination of flexible conduit 82, pivoting right angle couplings 80A and 80B, and swivel hose support rail 73, serve to allow free movement of the water jet carriage assembly 60 along the length of the tub enclosure 38.

Figure 7:
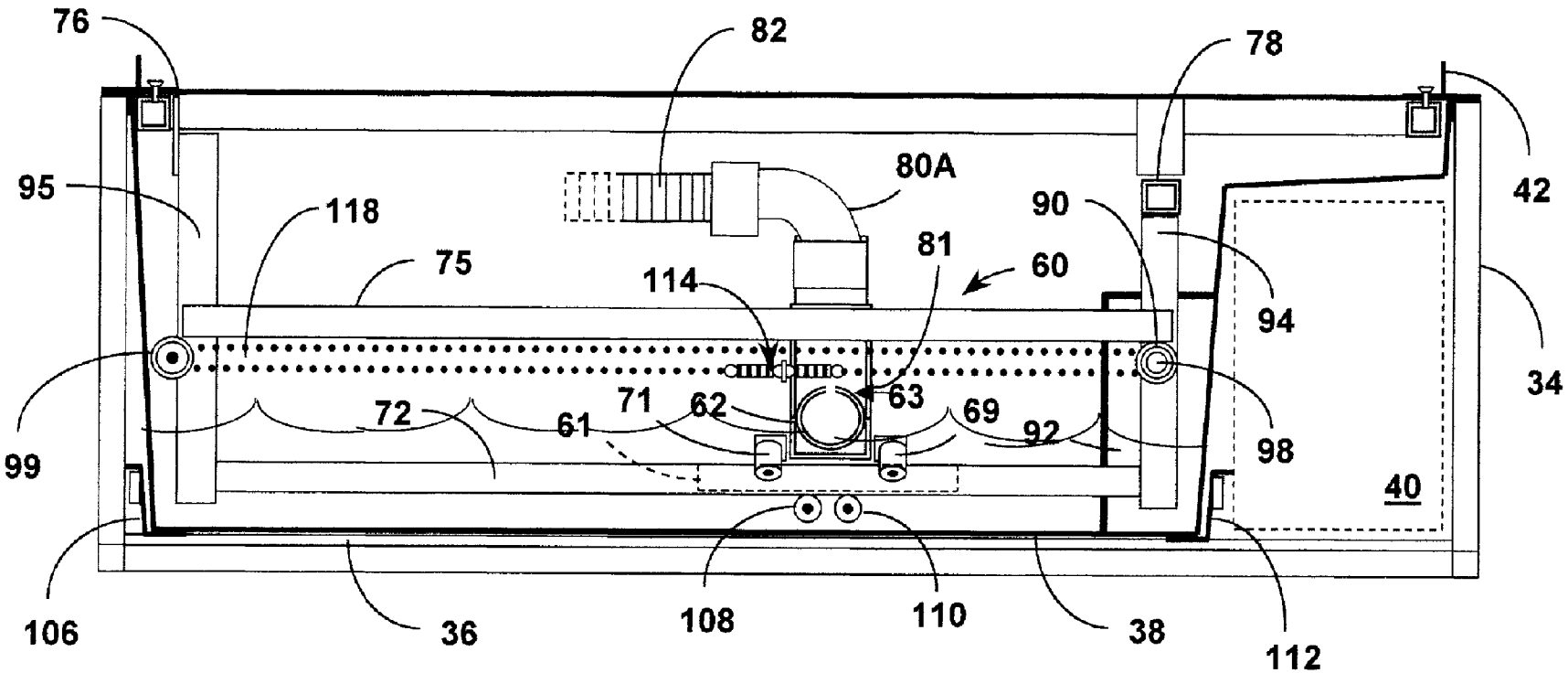
FIGS. 7 & 8 are partial cross-sectional views directed towards each end of the hydrotherapy subassembly of the system of the preferred embodiment viewed along sectional planes shown in FIG. 6.
Figure 8:
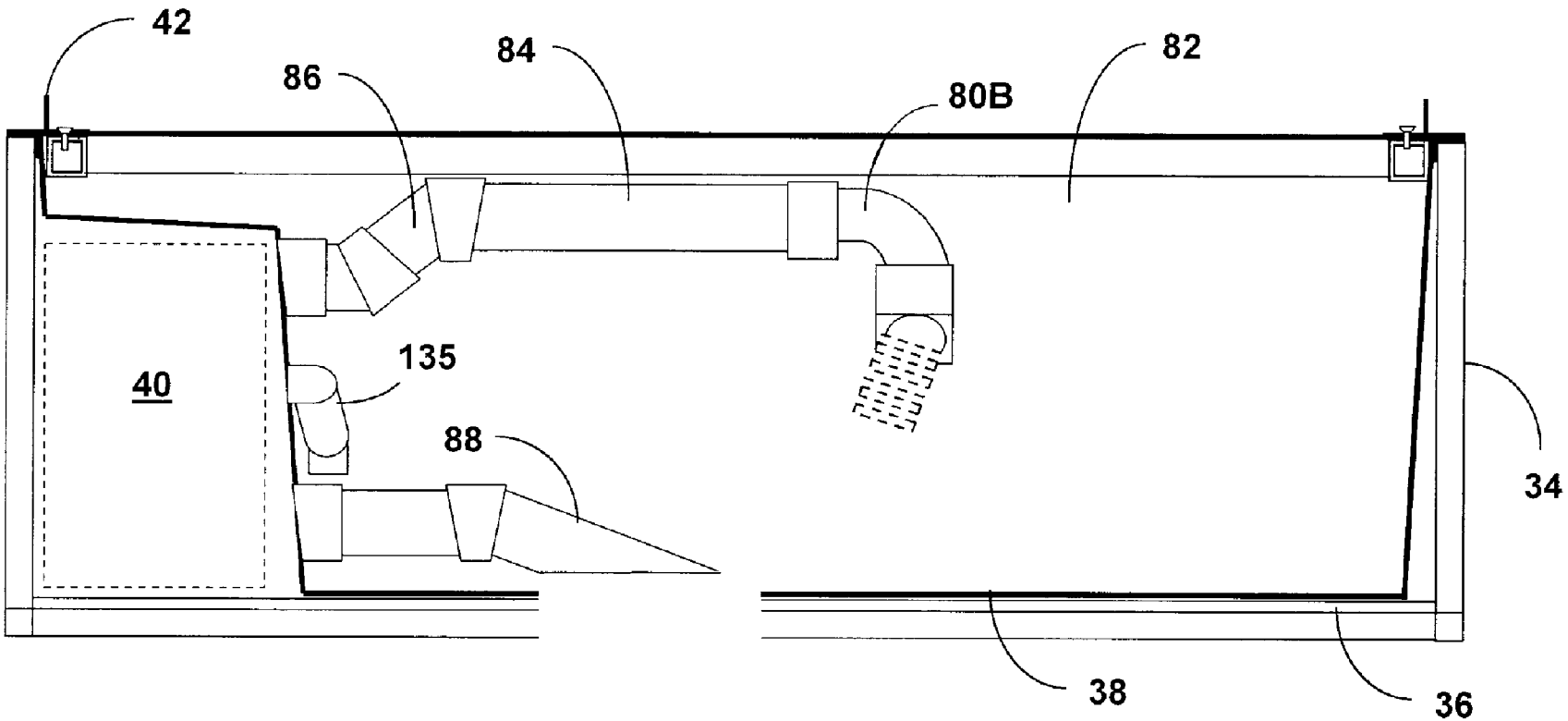

FIGS. 7 & 8 are partial cross-sectional views directed towards each end of the hydrotherapy subassembly of the system of the preferred embodiment, viewed along sectional planes shown in FIG. 6.

Reference is now made to FIGS. 7 and 8 for a brief description of the interior suspension framework within tub 38 of the hydrotherapy subassembly 20 of the preferred embodiment. FIG. 7 represents a partial cross-sectional view of the interior of tub 38 in the direction shown generally by the cross-section line 7-7 in FIG. 6. FIG. 8 is a partial cross-sectional view taken along cross-section line 8-8 shown in FIG. 6. FIG. 7 shows a portion of base frame 34 surrounding the material of tub 38 which is seen only in wall cross-section in FIGS. 7 and 8. Within the lower face of base frame 34 is positioned the flat panel layer of base platform 36. Between base platform 36 and the bottom of tub 38 is positioned heating element 70 as shown. In the preferred embodiment, the bottom wall of tub 38 is molded to incorporate a channel into the otherwise flat surface that allows for a single circuitous placement of a heating element 70 beneath the bottom wall of tub 38. In this manner the water to be contained within tub 38 may therefore be heated to the desired temperature by means of heating element 70. The thermostatic control of the heating element and thus of the temperature of the water within the system is described in more detail below.

Suspended within tub 38 is a framework constructed of aluminum components in the preferred embodiment that serves to support the functional internal elements of the system of the preferred embodiment. Base frame 34 supports upper frame 42 as shown. One component of upper frame 42 is an internal square tubular frame component that serves to create a rigid lip for tub 38 and to provide the attachment point for a number of the interface layers of the system. Positioned on and attached to this internal square tubing element of upper frame 42 is cross strut 78 which in the preferred embodiment is suspended downward from the internal perimeter element of upper frame 42 by welded hanger plates as shown. Attached to cross strut or member 78 are two vertical risers 94 and 96, which in the preferred embodiment, like cross member 78, are each constructed of square cross-section extruded aluminum tubular elements.

Attached to the bottom of each of vertical risers 94 and 96 are tubular rails 72 and 74, seen here in their circular cross-section only. Also attached to vertical riser 94 is one end of support rail 75 also shown only in its circular cross-section here. Spacing and separating vertical risers 94 and 96 near their base ends is spacer strut 102. This element, like most of the internal frame members of the system, is constructed of square cross-section extruded aluminum tubing and is simply welded to the vertical risers 94 and 96.

One portion of the interior volume of tub 38 at this end of the hydrotherapy subassembly of the system is side wall inclusion 92. This alteration of the otherwise flat and regular side wall of tub 38 provides a location for the positioning and attachment of a DC electric drive motor (not seen in this view) to the exterior side wall of tub 38. This drive motor is connected to a drive shaft 98 that extends through the wall of tub 38 (by way of a water tight bearing), through vertical riser 94 (also with a bearing in the preferred embodiment), and eventually through vertical riser 96 (also with a hard plastic bearing or the like). Positioned on this rotating drive shaft 98 is chain drive wheel 90, positioned as shown adjacent vertical riser 94. This drive wheel 90 and the DC electric drive motor provide the necessary rotational movement to the cable drive mechanism that pulls the water jet carriage assembly 60 longitudinally within the enclosure of tub 38. The manner in which this is accomplished is described in more detail below with respect to FIG. 9.

FIG. 8 looks in the opposite direction from FIG. 7, although still within the confines of tub 38. In this view, yet another section of base frame 34 is shown with base platform 36 in place and supporting tub 38. Other portions of heating element 70 are shown as they might be circuitously positioned between tub 38 and base platform 36.

Figure 10:
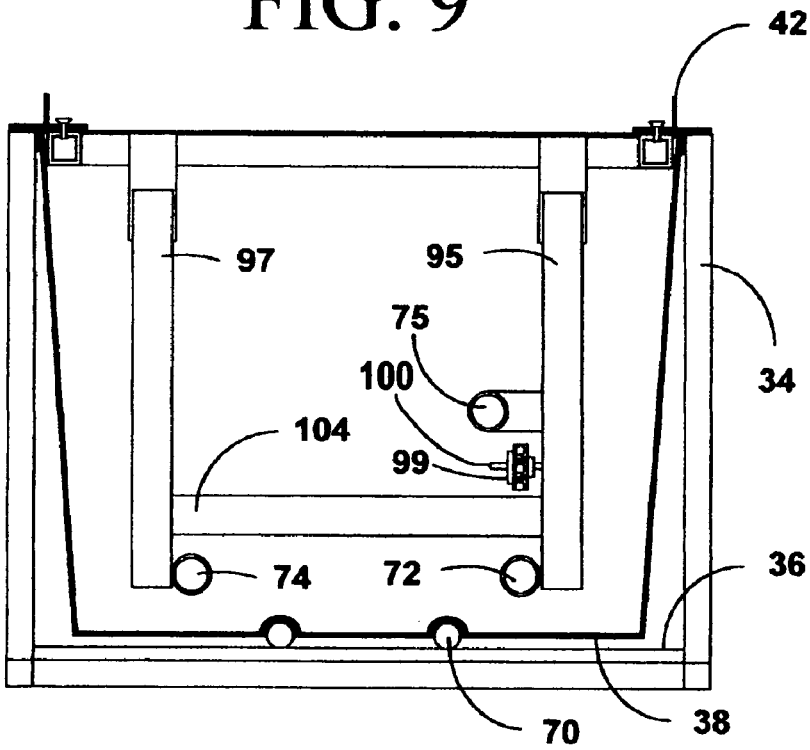
FIG. 10 is a longitudinal partial cross-sectional view of the hydrotherapy subassembly of the system of the preferred embodiment in a direction opposite that of FIG. 9, showing several of the water conduits of the system.

A rail suspension arrangement similar to that shown in FIG. 7 is incorporated at this opposite end of tub 38 of FIG 10. Again mounted to plates welded to perimeter frame element of upper frame 42 are vertical risers 95 and 97. These risers, however, depend from welded plates that are attached to the end cross member 78 of the interior perimeter element of upper frame 42 rather than from the sides as with the opposite end of the frame assembly. The same attachment points for tubular rails 72 and 74, as well as support rail 73, are provided. Likewise, a follower wheel 99 similar to the drive wheel 90 is rotatably mounted on a shortened shaft 100 that is positioned on vertical riser 95. Spacer strut 104, like spacer strut 102, serves to fix the distance between the rails of the system to minimize the possibility of carriage derailment.

Figure 9:
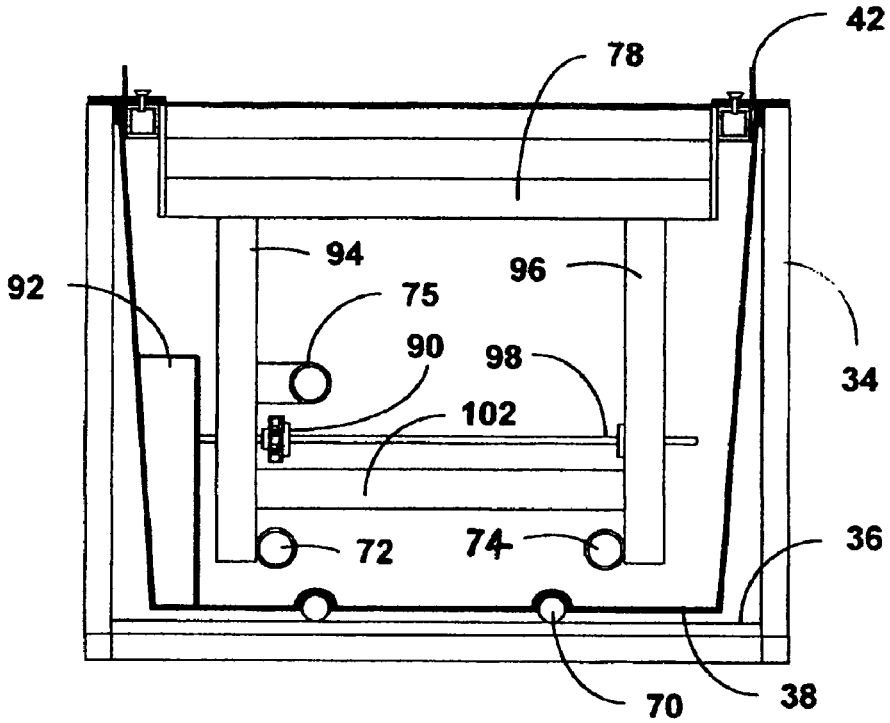
FIG. 9 is a longitudinal partial cross-sectional view of the hydrotherapy subassembly of the system of the preferred embodiment showing the moving water jet source and rail structure.

Reference is now made to FIG. 9 for a partial cross-sectional view of the interior elements of the system, along a longitudinal dimension of tub 38. In this view, two (94 and 95) of the four hanging vertical risers shown in FIGS. 7 and 8 are disclosed from the side. Cross strut 78 is shown in this view as serving to suspend vertical riser 94.

In this view it can be seen how drive 118 is connected around drive wheel 90 matching with follower wheel 99 at the opposite end of the internal framework to provide a continuous linkage that serves to drive (pull) the lateral movement of the water jet carriage assembly 60 of the system.

Support rail 75 is shown positioned between vertical riser 94 and vertical riser 95 at the opposite end of the length of tub 38. As described above, drive shaft 98 (seen in cross-section in FIG. 9) extends all the way through riser support 94 and into riser support 96 (shown in FIG. 7) to provide a rigid structure from which the drive motor (described in more detail below) may be positioned and mounted to drive the drive 118. Follower wheel 99 is not subject to the drive forces of the DC electric motor and is therefore maintained in position by a short shaft 100 attached simply to vertical riser 95.

Water jet carriage assembly 60 in FIG. 7 is shown in partial cross-section positioned along one of the two tubular rails (in this case, tubular rail 72). The manner in which water jet carriage assembly 60 straddles the two longitudinal tubular rails 72 and 74 is shown in more detail in FIG. 16. Water jet carriage assembly 60 is comprised primarily of jet manifold 62 positioned in cradle 81. Attached to the base of cradle 81 are two wheel assemblies, one associated with each rail and therefore only one of which is seen in the partial cross sectional view of FIG. 2. The wheel assembly shown comprises three pairs of hard plastic rollers or wheels that allow this end of carriage 60 to smoothly glide along tubular rail 72. Two under-rail wheels 108 and 110 are seen positioned beneath tubular rail 72 while two angled over-rail wheels 69 and 71 are shown positioned above tubular rail 72 in a manner that holds carriage 60 captive against rail 72. An additional pair of angled over-rail wheels 68 and 73 positioned on top of rail 72 at an angle orthogonal to wheels 69 and 71 respectively. Upper roller 64 is opposite lower roller 109 on track 74. Upper roller 66 is opposite another lower roller like roller 109 on track 74.

Figure 16:
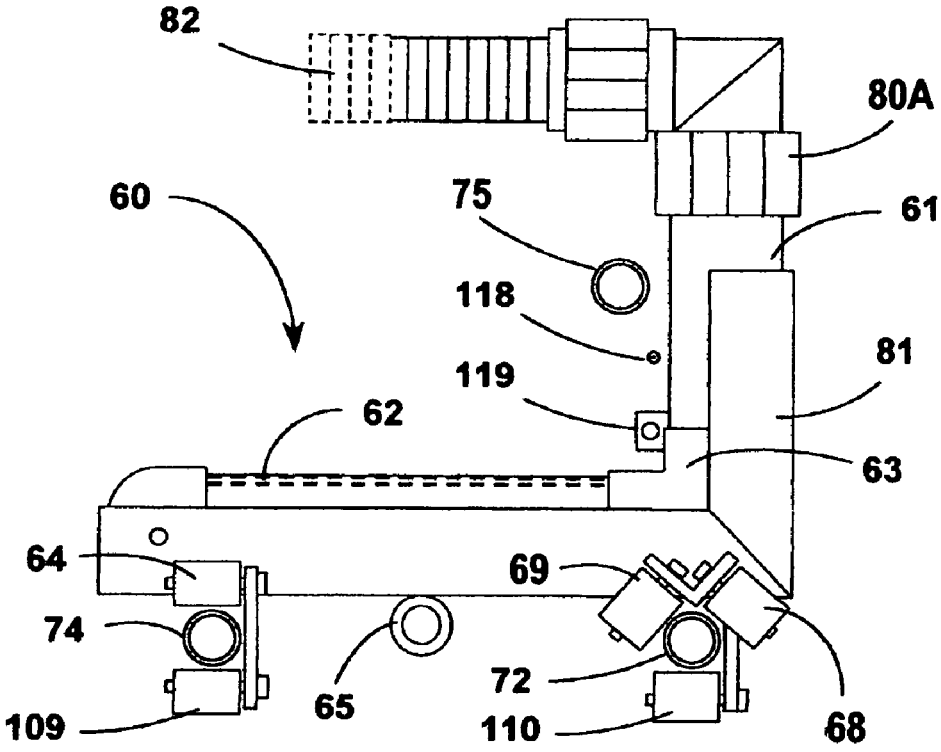
FIG. 16 is a detailed side view of the movable water jet source component of the system of the preferred embodiment.

Carriage 60 is directed along rail 72 by the bi-directional pull of chain drive cable 118 positioned in drive wheel 90 and follower wheel 99. The bi-directional drive motor (not shown) turns drive shaft 98 and drive wheel 90 which in turn direct drive cable 118 in a closed loop manner. Each end of drive cable 118 is attached through a spring to a chain bracket 120 on carriage 60 in a manner that secures carriage 60 to a fixed point on drive cable 118. The rotational movement, therefore of drive shaft 98, as driven by the electric drive motor (not shown) results in the transitional movement of carriage 60 along rail 72. A corresponding second wheel assembly and rail interaction occurs with the second rail in the system not seen in the view of FIG. 9. While this second wheel assembly structure is shown in FIG. 16, the function is essentially the same as that for the first wheel assembly described herein.

Jet manifold 62 incorporates a tube with a series of spaced longitudinal slits 63 along its length at a top edge which serve to provide the water spray (directed in an upward orientation) within the interior of the tub enclosure 38. These jets of water impinge upon the underside of the interface layers placed over and sealed to the perimeter rim of tub 38 (as described in detail below) and thereby upon the human subject reclining on the surface of the system. The carriage and rail system shown in FIG. 9 serve to move these jets of water longitudinally back and forth along the length of the enclosure according to the programmed movement of the carriage and the programmed pressure of the water in the water feed lines. The supply water to jet manifold 62 is provided by way of a first pivoting right angle coupling 80A which couples the rigid "L" shaped conduit assembly of water jet carriage 60 to flexible hose 82 that is eventually connected to the pump system of the preferred embodiment. A second pivoting right angle coupling 80B connects between the opposite end of hose 82 to supply line 84. Therefore, as carriage assembly 60 moves longitudinally back and forth along the length of rail 72, flexible hose 82 and pivoting couplings 80A and 80B allow for this movement while maintaining the continuous supply of water to the water jet assembly. The benefits of using the flexible hose 82 and pivoting couplings 80A and 80B include less stress on hose 82, greater travel distance, less stress on motor and drive cable.

At either end of the longitudinal dimension of tub 38 are positioned sensors 106 and 112. These sensors respond to the magnetic field created by magnetic position indicator 61 (shown in dashed outline form in this view for clarity). As carriage assembly 60 moves towards either end of rail 72, and therefore either end of the longitudinal dimension of tub 38, magnetic position indicator 61 comes into close proximity to either sensor 106 or 112. These position indicators/sensors serve to tell the system when the carriage assembly has reached its longitudinal extent in either direction. In this manner, the motor control drive may be shut down and/or reversed according to the requirements of the programming.

In addition, the indicator/sensor combination serve to help prevent damage (carriage derailment, chain detachment, etc.) to the system by inadvertently driving the carriage assembly past its end points.

Finally in FIG. 9, the space within which the water pump and control system of the preferred embodiment are located is generally identified by the dashed outline of space 40. The specifics of the components positioned in this space are described in more detail below.

Reference is now made to FIG. 10 for a detailed description of the remaining components positioned within the interior of tub 38. This view in FIG. 10 is directed generally opposite to the view shown in FIG. 9 with the interior framework removed to allow for a clear view of the water plumbing system incorporated within the confines of the tub.

Base frame 34 is shown again with base panel 36 positioned to support the weight of tub 38. The interior volume within tub 38 in this view comprises the area immediately adjacent one side wall of the tub and incorporates the various plumbing conduits associated with the delivery and return of water to and from the system. In this view, the space 40 occupied by the pump and control system is again generally disclosed to one exterior side of tub 38. Upper frame 42 is shown positioned along the edge of tub 38 in a manner that provides the rigid perimeter support described above. Within the enclosed space of tub 38 are three separate pipe conduit sections. A first set of rigid pipe connections comprising water inlet couplers 86 and water feed pipe 84 delivers high-pressure water to flexible conduit 82 which in turn is connected to coupling 80A as described above. This conduit series supplies the pressurized water to the water jet carriage assembly and thus out from the water jets, again as described above. In this view and in the view of FIG. 9, flexible hose 82 is a single component whose end is shown in dashed outline form only to indicate that the component continues into the next figure.

A return pipe 88 is positioned as shown with an inlet immediately above the base of tub 38. At a height approximately half as deep as tub 38, is air vent conduit 135 oriented and positioned as shown.

Figure 11:
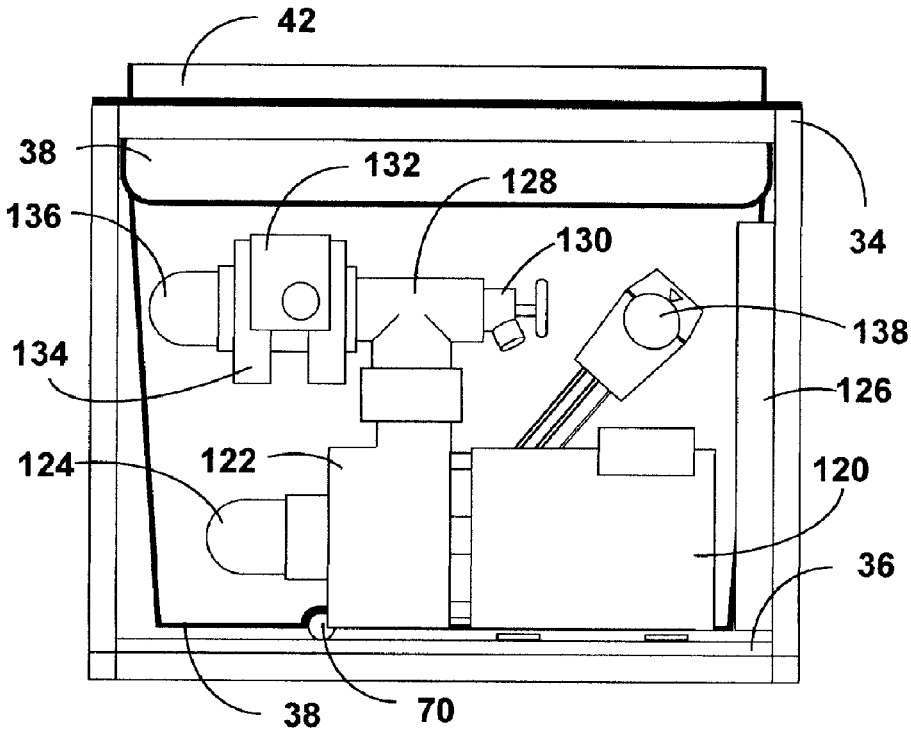
FIG. 11 is an end view of the core tub component of the system of the preferred embodiment, with an end cover removed, showing the water pump, valve, and control systems.
Figure 12:
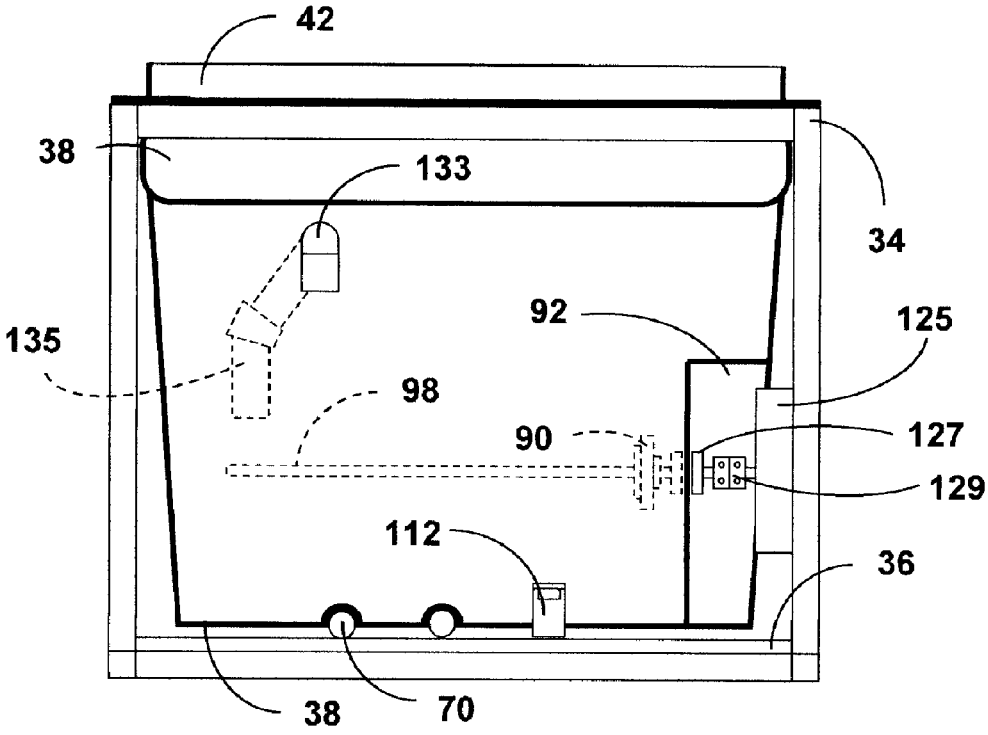
FIG. 12 is a deeper layer end view of the hydrotherapy subassembly of the preferred embodiment disclosing the elements behind the water pump, valve, and control systems shown in FIG. 11.

The external components that operate, control, and drive the system of the preferred embodiment (and which heretofore have been generally labeled as being in space 40) are shown in more detail in FIGS. 11 and 12. FIG. 11 is a plan view from one end of the hydrotherapy subassembly of the preferred embodiment, with the covers removed, showing the assembly of pumps, conduits, and other control components associated with the functional operation of the invention. In this view, base frame 34 is again shown with base platform 36 positioned in a manner that supports tub 38 and additionally supports the components associated with the pump and controls of the system. One of the two heater element ends 70 is shown in this view where it exits from underneath tub 38.

The primary operational components of the system include electric pump motor 120, water pump 122, and pump return (inlet) 124. A conduit "T" connector 128 is coupled to the outlet of water pump 122 and provides the source for the flow of water into the tub enclosure of the system. A water fill valve 130 is positioned at one branch of "T" connector 128 and is used to initially fill the system, or in some instances to drain the system of the stored water.

Flow control valve 134 is driven by an electric stepping motor 132 under the control of the microprocessor based controller system of the preferred embodiment described in more detail below. Control valve 134 connects to pressurized water port 136, through the wall of tub 38 and into the interior of the tub. In this view, the shallow recessed shelf area of tub 38 is shown in cross-section. Upper frame 42 is shown extending across the entire width of this end of the hydrotherapy subassembly of the system of the preferred embodiment.

Also shown in FIG. 11 are controller cabinet 126 and heater thermostat 138. Controller cabinet 126 houses the circuit boards and electric/electronic components required to control and operate the system. The details of the controller components are described below. Heater thermostat 138 is a handheld component that is fitted between the electrical connections on the heating elements 70 and the heater relays within the controller cabinet 126.

FIG. 12 is a view of the same end of the hydrotherapy subassembly of the system of the preferred embodiment as shown in FIG. 11, but with the primary functional components removed. In this view, the exterior wall of one end of tub 38 can be seen. Heater elements 70 are again shown where they exit from between tub 38 and base platform 36. Position end sensor 112 is shown and functions as described above with respect to FIG. 9.

The primary functional component shown and described in FIG. 12 is DC reversible drive motor 125 which is connected by way of shaft coupling 129 to drive shaft 98, shown in this view in dashed outline form. Sidewall inclusion 92 is seen from an external vantage point in this view, and is shown from an internal vantage point in FIG. 9. This inclusion in the wall of tub 38 allows for drive motor 125 to be positioned adjacent the aperture through which drive shaft 98 is directed. Rotating seals 127 are positioned through the aperture in the wall of tub 38 to prevent water from leaking out through the aperture while permitting the drive shaft to turn. Drive wheel 90 is shown in this view in dashed outline form being interior to the walled enclosure of tub 38 (as is drive shaft 98).

Finally disclosed in FIG. 12 is the configuration and arrangement of air vent conduit 135 shown in dashed outline form interior to the enclosed volume of tub 38 with external vent port 133 directed outward and down from this wall of tub 38. Vent conduit 135 along with external vent port 133 serve to allow the escape of air from the enclosed space of the interior volume of tub 38 and at the same time provide an overflow port for the system.

Figure 13:
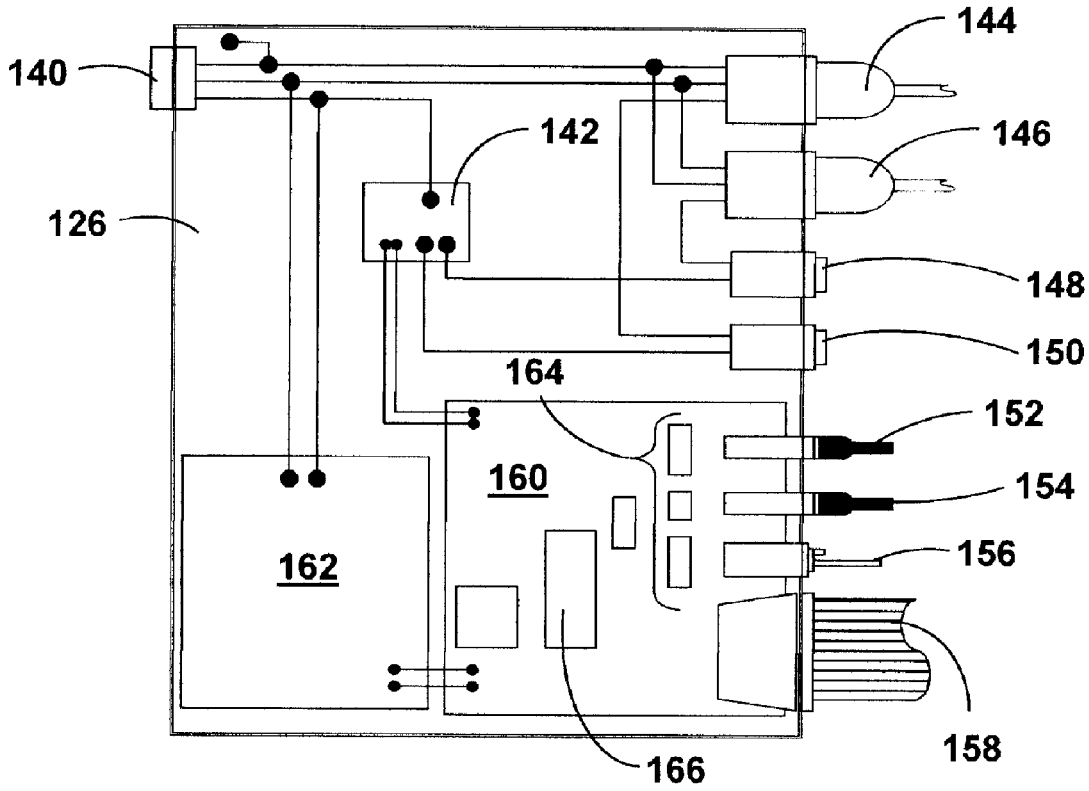
FIG. 13 is a plan view of the controller component enclosure of the system of the preferred embodiment and the various electrical and electronic connections.

The control of the system of the preferred embodiment is carried out by an array of electrical/electronic devices contained within controller cabinet 126 shown in schematic block form in FIG. 13. In this view, which does disclose the preferred layout of the components and the arrangement of the connections for the control of the preferred embodiment, all of the electrical and electronic elements within the system are addressed or described. Power is provided to the system by way of 110 VAC electrical power input 140 into the controller cabinet 126. This 110 VAC power source would, in the preferred embodiment, incorporate a ground fault interrupt (GFI) circuit for safety. Typical wiring and electrical conductors are provided for the system according to the necessary gauge wire and type of wire appropriate for its use. In this view, a ground wire is provided between the AC electrical power input 140 and each of the two primary AC output connectors 144 and 146. Power connector 144 provides electrical power to the water pump, while power connector 146 provides electrical power to the water heater. Circuit breaker 148 is a 3-amp breaker in the preferred embodiment and serves to protect the water heater circuit. Circuit breaker 150 is a 15-amp breaker in the preferred embodiment and serves to protect the water pump circuit. One phase of the AC power supply is provided to each of the two output connectors 144 and 146 while the second is provided through a 110 VAC power relay 142 that switches the power on and off for both the water heater and/or the water pump.

110 VAC power is also provided to a 12-volt DC output power supply 162. This 12-volt supply provides the necessary voltage for the digital components positioned on the main control circuit board assembly 160. The primary component on the main control circuit board assembly is microprocessor 166, although a plurality of drivers 164 provides the motor driver control as well as the control of the power relay 142.

Microprocessor 166 serves to receive sensor input from the various position sensors and user hand controls provided in the preferred embodiment. Sensor interface connector 158 primarily serves to input the position information provided by magnetic sensor assembly associated with the longitudinal position of the water jet carriage. User handheld control unit connection 156 serves to provide the user of the system with control input capabilities directed from the handheld controller 200 shown in FIG. 1. Output to the handheld controller is also provided by way of this serial port. Connectors 152 and 154 serve as outputs to the valve motor control (connection 152) and track drive motor control (connection 154).

The controller assembly shown in FIG. 13 and described above provides the necessary electronic and electrical controls to carry out both the operation of the water pump and the movement of the water jet carriage within the contained enclosure. A wide range of programmed movements and pressurized water spray are possible using the programming features of the preferred embodiment. By controlling the direction and speed of the track drive motor, the controller can position the water jet spray appropriately for the human subject reclined on the system. The temperature of the water may also be monitored and controlled within the control system shown in FIG. 13 in combination with the heater thermostat control 138 shown in FIG. 11.

Figure 14:
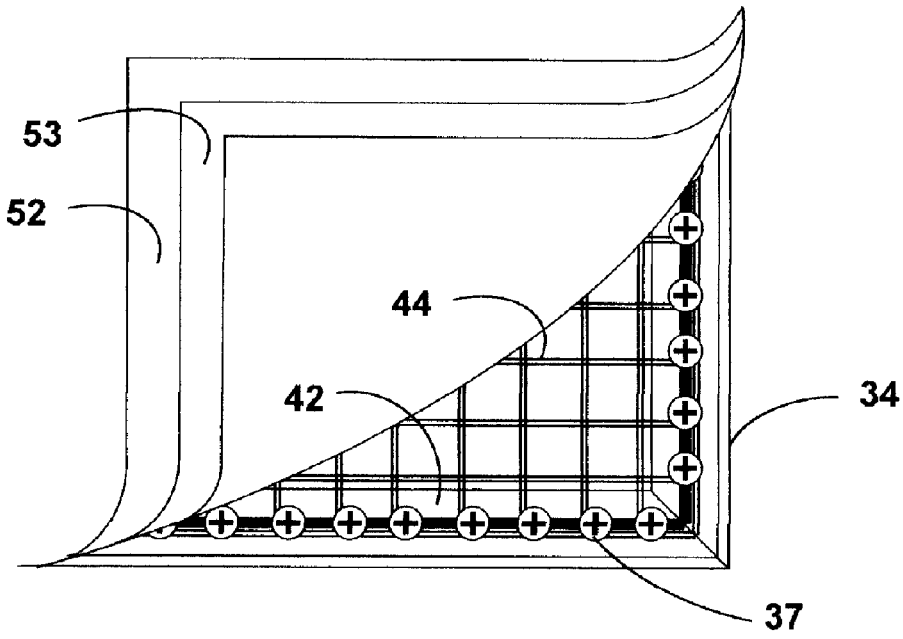
FIG. 14 is a detailed top view of one corner of the hydrotherapy subassembly of the system of the preferred embodiment showing the manner of layered surface attachment and sealing to the perimeter edge of the hydrotherapy subassembly.

Reference is now made to FIGS. 14 and 15, which disclose in detail one corner of the top layering system of the support surface of the preferred embodiment. FIG. 15 shows, in cross-sectional detail, the same components in the system of the preferred embodiment where the support surface layers are attached to the perimeter edge of the tub enclosure. In FIG. 11, one corner of the system is shown as being typical of each of the four corners of the rectangular support surface. On this corner, base frame 34 supports and position upper frame 42 which integrates an array of threaded posts 37 positioned to receive and hold web layer 44. The square cross-section interior element of upper frame 42 may either be attached to the extruded aluminum structure of the frame or may be integrally extruded with the associated lips and edges. Upper frame 42 is bolted to base frame 34 by way of bolts 35 as shown.

On this structure, a mesh of polyester cord support netting 44 may be stretched tightly and secured around each of the threaded posts 37 to provide the necessary taut support surface to allow the reclined human subject to lay on the platform and not depress the surface material beyond a minor extent. Thus, while the support netting is strong enough to allow the human subject to fully recline on the surface of the system; it is open enough to allow for the full force of the water jets to impinge upon the underside of the waterproof layer that overlays the netting.

Overlaying support netting 44 is a flexible waterproof surface barrier 52 that is sufficiently thin as to transfer the forces associated with the water jets impinging upon it from below to the human subject that reclines on top, while at the same time is sufficiently resilient and strong as to prevent tears and holes from developing over repeated use. In the preferred embodiment, a polyurethane sheet, approximately 5.0 millimeters thick is appropriate for retaining both the integrity of the cover and the flexibility necessary to transfer the massaging force of the water from underneath.

A reinforcing strip 53 is positioned on the underside of waterproof surface barrier 52 to prevent threaded posts 37 from damaging the other wise pliable layer of waterproof material. The manner in which the layered top sheet combination is attached to the perimeter upper frame 42 is described in more detail below.

FIG. 15 shows in cross-sectional detail the manner of attachment of the support layers and surface layers of the system of the preferred embodiment to the perimeter frame. In this cross-sectional view, the upper edge wall thickness of tub 38 is disclosed. On either side of this rim of tub 38 are positioned metal structures sufficient to provide rigidity to the rim and to provide the attachment points for the various top layers of the system. Exterior to tub 38 is a component of base frame 34 which in the preferred embodiment is a simple section of extruded angle aluminum bar, the cross-section of which is shown in FIG. 15. This aluminum bar may be attached at various points directly to the wall of tub 38 in any of a variety of appropriate ways well known in the art. Such attachment might involve an adhesive or may simply involve the periodic placement of rivets or bolts through apertures drilled in both the angled metal bar and the tub wall.

Attached to the top edge surface thus created by base frame 34 is the upper frame (assembly) 42. In this cross-sectional view it can be seen that upper frame 42 is comprised of a "T" shaped section of bar integrally connected with a square cross-section tube component positioned on the interior of tub wall 38. This construction may be integral or may be assembled in the manner shown. In any event, the critical elements are the rim wall 43 that is presented in a manner generally parallel to the direction of tub wall 38. This vertical rim wall 43 is intended to receive and secure the perimeter edge of the waterproof surface barrier 52 in a manner described in more detail below.

Prior to the installation of the surface barrier 52, however, the support netting 44 is attached to the perimeter of the tub enclosure by means of stretching individual cells in the netting over the slightly elevated threaded posts 37 intermittently spaced around upper frame 42 (see FIG. 11). Once the netting 44 has been stretched in its entirety and has been secured to each of the appropriately positioned threaded posts 37, a liquid impermeable surface is provided across the opening of tub 38. It is through this netting that the water jets may be directed to impinge upon the underside of the human subject reclining on the surface of the system. In order to prevent the escape of water from the system and to prevent the human subject from themselves becoming wet, the waterproof surface on which the human subject reclines is positioned and secured to the upper frame 42 over the netting. This waterproof surface barrier 52 need not be so durable as to support the weight of the human subject since such weight is supported entirely by the taut netting 44. Rather, the waterproof layer must simply serve to seal the support surface and therefore the interior of the tub 38.

The above described sealing of the tub is accomplished as shown in FIG. 15 by positioning the waterproof surface barrier 52 over the vertical rim wall 43 and securing it to the same by way of channel clamp seals 54. The press fit clips and channels that serve to secure the waterproof surface barrier are seen more fully in the exploded view in FIG. 5. In FIG. 15 a representative section of seal 54 is disclosed in cross-section.

Figure 17:
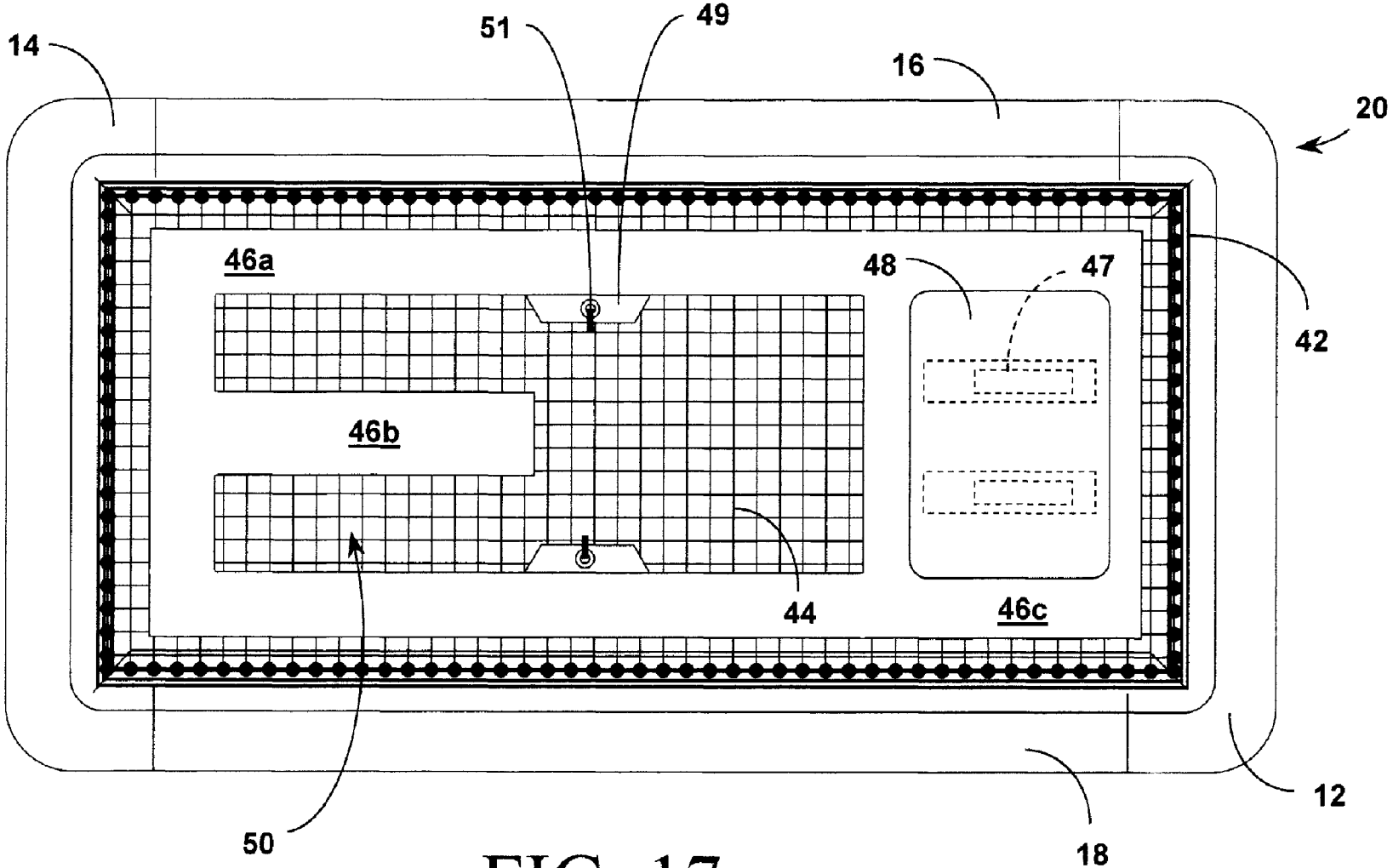
FIG. 17 is a top plan view of the hydrotherapy subassembly of the system of the preferred embodiment with the top barrier layer removed to show the cushion mask layer of the system.

Reference is finally made to FIG. 17 for a more detailed description of the intermediate mask layer positioned between the netting described above and the top waterproof surface barrier also described above. Barrier cushion mask 46 (as also shown in FIG. 5) is positioned on top of netting 44 and provides a masking block against the force of the water jet being sprayed up from below within the enclosure against the underside of the waterproof surface barrier. In this manner the massaging forces of the water jet may be isolated to specific parts of the body of the human subject. The mask therefore takes on the configuration of those portions of the human body that require such dry hydrotherapy massage and those that do not. The mask open space 50 therefore, defined by sections 46*a*, 46*b*, and 46*c* of mask 46 allow the force of the massaging water jets to reach the human subject positioned on the system of the preferred embodiment.

Although sleep system 310 contains two side-by-side systems 10*a* & 10*b* like hydrotherapy sleep system 10 of FIG. 1, system 310 unites those two sleep systems 10*a* & 10*b* with an overlying quilted topper 331 to form a queen-sized surface as shown. In addition to the overlying quilted topper 331, side and end panels 324 and 328 are provided with quilting and other outer surface effects to give hydrotherapy sleep system 310 the overall appearance of a conventional box spring assembly and mattress. Other features such as pillows 325 are also added to further convey the appearance and general functionality of a bed for double-occupancy. Hence, system 310 is adapted for simultaneous use by two users, such as a husband and wife, to provide a hydrotherapy sleep surface of the present invention for the benefit of both such users Independent hand-held controls are provided with system 310 so that the user of system 10*a* us able to control that system 10*a* independently of the control of the companion system 10*b*, and vice versa. More particularly, as shown if FIG. 1A, the left sleep system 10*a* is provided with hand-held hydrotherapy control unit 200*a* and hand-held sleep surface controls 230*a*. In contrast, sleep system 10*b* is provided with a single, unified hand-held control 300. Dry hydrotherapy sleep system 310 is thus adapted for supporting two patients on a single surface 331, in an embodiment particularly well-suited for a residential home environment.

FIG. 1B shows a perspective view of a yet another alternative embodiment in its assembly and enclosed configuration, namely a built-in dry hydrotherapy system 410. Built-in dry hydrotherapy system 410 is adapted for providing dry hydrotherapy in a unit integrated into a surrounding household structure 400. The hydrotherapy components of system 410 are much the same as the components of the hydrotherapy subassembly 20 of FIG. 2, except that the upper perimeter bolsters 12 and 16 are secured to both the upper frame of the hydrotherapy subassembly as well as to structure 400. The fiber formed exterior panels 22, 24 and 28 of the system 10 of FIG. 1 are also not required with built-in system 410, as system 410 is placed in a permanent location within a home or facility.

Household structure 400 is preferably a marble, wood or tile counter or the like, such as is often used in residential applications to surround a conventional bath tube or an in home jetted tub. System 410 is designed to be installed in a bathing room or the like, in the place of such other conventional tubs, and the structure 400 can be finished out by the builder or trim carpenter to match the room's exterior surfaces. Counter 400 is preferably reinforced and affixed to the structure of a residential house or bathing facility. Counter 400 is provided with a small circular opening 401 to allow for operable passage of hand control line 201 from the space above the counter to the other hydrotherapy components of system 410 that are below the counter 400. Counter 400 is also provided with a rectangular opening 402 to accommodate the tub and other hydrotherapy components of system 400.

Although not detailed in FIG. 1B. the plumbing and electrical requirements of built-in hydrotherapy system 410 are integrally connected with the plumbing and electrical systems of the surrounding structure 400 in a manner that will be understood by those of skill in housing and bath construction. More particularly, the hydrotherapy components of system 410 are connected with the household plumbing of the house or other facility, to provide connection with both hot and cold water lines and drain or sewer connection, and 220-volt power is provided through connection to the electrical wiring of the facility. Automatic fill and drain control, automatic temperature regulation, and automatic water level detection are all provided in the preferred embodiment of system 410. As such, system 410 is adapted as a built-in for providing dry hydrotherapy in the home, preferably for installation in new construction applications or to replace existing in-home tubs (space permitting).

Figure 18:
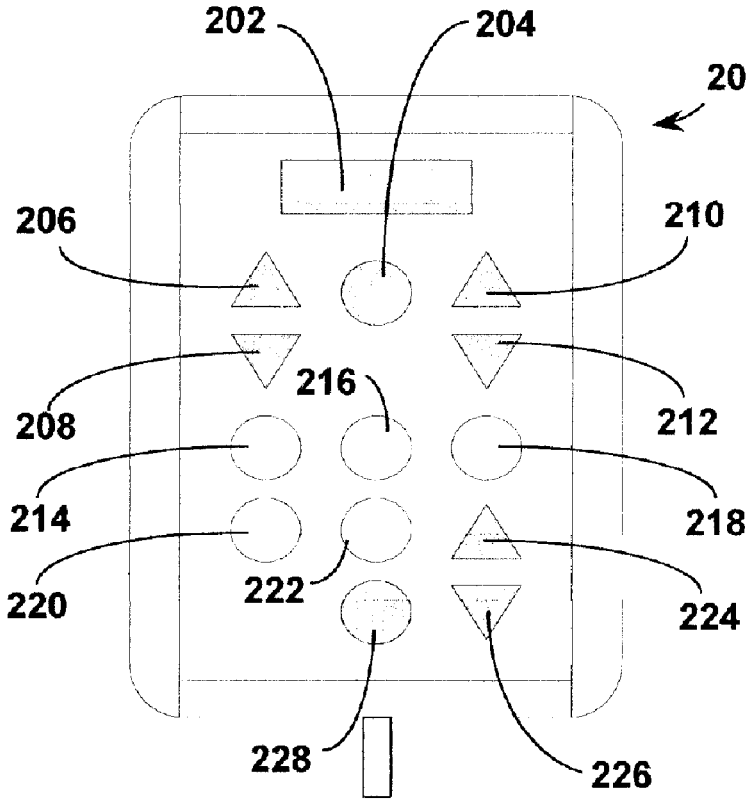
FIG. 18 is a plan view of the hand-held user control unit 200 for the core hydrotherapy system 20 of FIG. 2., showing the control functions available to the user to modify the method of operation of the hydrotherapy system of the preferred embodiment.

An understanding of the method of operating the systems 10, 310 and 410 of the preferred embodiments may best be achieved by a description of the functionality associated with the handheld user controls of those systems 10, 310 and 410. The most basic hydrotherapy functions are best described with reference to the hydrotherapy hand control 200 initially disclosed in FIG. 1, which is the same as hand control 200*a* of FIG. 1A and 200*b* of FIG. 1B. The buttons and controls of hand control 200 are also the same as the buttons and controls corresponding to the hydrotherapy control portion 380 of hand control 300 of FIG. IA (shown in more detail in FIG. 20). Hand control 200 for the core hydrotherapy system 20 of FIG. 2 is shown in greater detail in FIG. 18, which shows the control functions and the display available to the user for modifying the method of operation of the hydrotherapy system 20 and to view the status of such operation.

The power control button 204 of the hydrotherapy hand-control turns the system on and off. When the system is initially turned on, the jet moves in full body mode at relative speed (2) and relative pressure (2).

The speed control feature of the hydrotherapy hand-control allows for the selection of up to five different speeds. A zero (0) is the stop setting wherein the jet does not move, while a five (5) is the fastest speed. The directional arrow buttons 206 and 208 serve to increase or decrease the speed of the motion of the moving water jet carriage assembly.

The pressure control feature of the hydrotherapy hand-control for the selection of up to seven pressure settings. A zero (0) is the stop setting wherein no water pressure is generated, while a seven (7) delivers the most pressure. The directional arrow buttons 210 and 212 serve to increase or decrease the pressure of the water being delivered through the water jet assembly.

The reset button 214 feature of the hydrotherapy hand-control allows the user to reset the system from any setting chosen manually to return to the default automatic full body travel. On reset the manually selected pressure and speed will be maintained.

The upper limit button 216 and lower limit button 218 function to allow the system to accommodate users of varying heights (or to limit the system to certain "body zones"). The limits define the longitudinal travel limits for the water jet carriage assembly and therefore the portion of the body covered by the massage therapy. The user set these limits while the system is operating by depressing the relevant button when the system has reached the desired positional limit.

The "Preset" button 220 allows for pre-programmed therapies to be implemented with variations in body zone, pressure, and duration. A menu of pre-programmed therapies may be accessed by repeatedly pressing the "Preset" button 220 and viewing the selection on the LCD display 202. Selection of a particular therapy involves pushing the "Up" direction button 224 followed by the power button 204. These pre-programmed therapies are set, in the preferred embodiment, during the manufacture of the system and the programming of the microprocessor in the controller. Minor modification of the system would permit users to enter and store their own therapies for repeated use.

The "Add Time" button/function 222 allows the user to extend the time that the system operates beyond the default 10 minutes. Time may be added by repeatedly pushing the "Add Time" button to select additional 5-minute increments up to 60 minutes total.

The system may be manually paused in the middle of a cycle (therapy) by pressing the "Pause" button 228. This stops the motion of the water jet carriage but does not stop the water jet itself. In this manner the user may focus the therapy on one or more spots or body zones. To resume the standard cycle the "Pause" button is simply pressed again.

The LCD Screen 202 indicates whether the device is turned on. The screen displays the relative speed of the moving water jet carriage assembly, the relative pressure of the water being delivered to the system by the pump, and the time when these various functions are being accessed.

Figure 19:
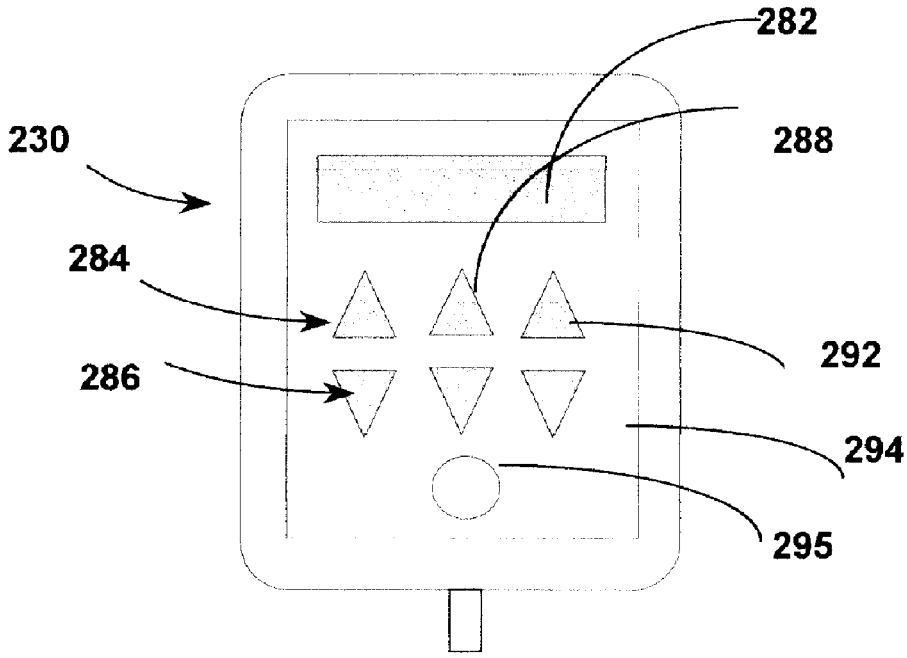
FIG. 19 is a plan view of the hand-held user control unit 230 for the sleep system 30 of FIG. 1, showing the control functions available to the user to modify the method of operation of the sleep system of the preferred embodiment.

As with the hydrotherapy functions, the most basic sleep functions are best described with reference to the sleep surface hand control 230 initially disclosed in FIG. 1, which is the same as hand control 230*a* of FIG. 1A. The buttons and controls of sleep surface hand control 230 are also comparable to the buttons and controls corresponding to the sleep surface control portion 390 of unified hand control 300 of FIG. 1A (shown in more detail in FIG. 20). Sleep surface hand control 230 for the sleep surface 30 of FIG. 4 is shown in greater detail in FIG. 19, showing the control functions available to the user to modify the method of operation of the sleep system 30 of the preferred embodiment.

The power control button 295 of the sleep surface hand-control turns the basic air moving system 270 (shown in FIG. 4) on and off for the sleep system 30. When the air moving system 270 is initially turned on, the air mover 250 is powered to inflate mattress 32 either to default levels of inflation, or to levels of inflation previously stored in memory by a user of sleep system 30.

The inflation control feature of the sleep surface hand-control 230 allows for the selection of low, medium or high inflation levels for each of the three sections of the inflatable mattress 32. The directional arrow buttons 284 and 286 serve respectively to increase or decrease the inflation level of the foot section 32*a* of mattress 32. The directional arrow buttons 288 and 290 serve respectively to increase or decrease the inflation level of the seat section 32*b*; and the directional arrow buttons 292 and 294 serve respectively to increase or decrease the inflation level of the upper torso section 32*c* of mattress 32.

The LCD screen 282 displays indications whether the sleep surface 30 is turned on, as well as inflation settings of the mattress sections 32*a*-32*c*. The screen 282 also displays the clock time and other feature displays as may be desired.

Figure 20:
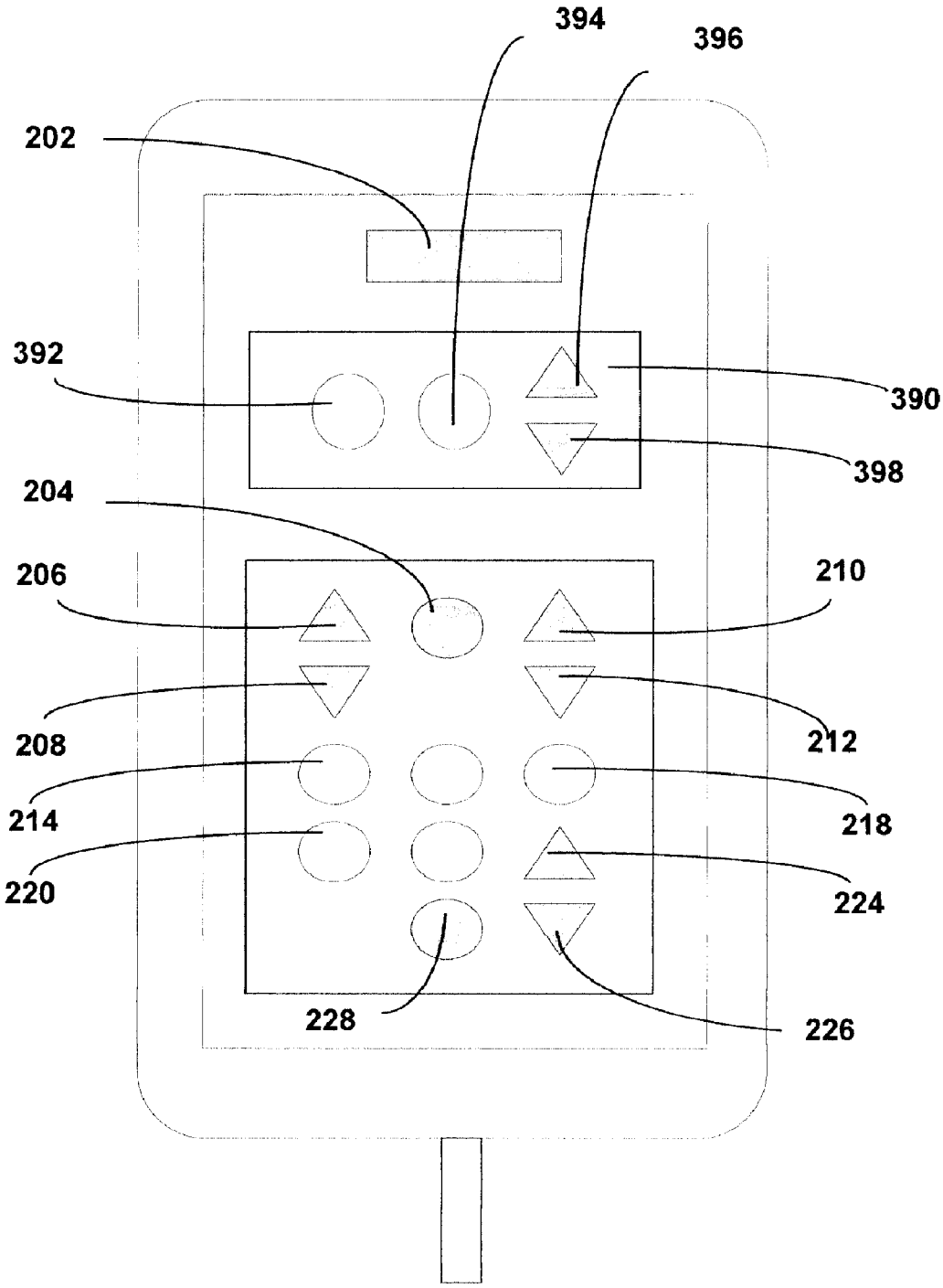
FIG. 20 is a plan view of the unified hand-held user control unit 300 of the alternative embodiment shown in FIG. 1A, combining the functions of a sleep system hand-held user control unit 230*a* with those of a hydrotherapy hand-held use control unit 200*a* into a single hand-held unit 300.

Alternatively, with reference to FIG. 20, hand controls 200 and 230 of FIG. 1 may be replaced in any embodiment with a unified hand-held user control unit 300, such as depicted for one side of the alternative embodiment shown in FIG. 1A. Such a unified hand control 300 combining the functions of a sleep system hand-held user control unit 230*a* with those of a hydrotherapy hand-held user control unit 200*a* into a single hand-held unit 300. As such, unified hand control 300 allows the user to operate the functions of hydrotherapy subassembly 20 as well as sleep system sub-assembly 30.

Although comparable to many of the functions of hand control 230, the buttons and corresponding controls of the sleep system control portion 390 of unified control 300 are somewhat different. Particularly, button 394 is a mode selector button which correlates with indicators displayed on display 202 to allow selection and scrolling through the various functions of sleep surface subsystem 30. Such functions include not only the inflation adjustment modes for each of the three mattress section 32*a*-32*c*, but also includes the ability to select any one of multiple stored memory settings for the overall inflation levels of mattress 32, such as may be preferred to store and recall customized settings for each particular user of system 10. When controlled to mode allowing adjustment of the inflation settings for each of the three mattress section 32*a*-32*c*, arrow buttons 396 & 398 are then used to respectively raise or lower such settings.

Programming button 392 of hand control 300 allows analogous selection of various functions of the hydrotherapy subassembly 20, in a manner that can be coordinated with the setting for sleep subsystem 30. More particularly, button 392 is a mode selector button, which correlates with indicators displayed on display 202, and arrow buttons 396 & 398 to allow selection and scrolling through various coordinating settings such as to customize a specific cycle for operation. For instance, button 392 can be used to select sleep time, pause times, and other therapy times for both subsystems 20 and 30. Whenever hydrotherapy is either manually selected with control 300 or when it is preset to be initiated using programming button 392, the sleep system will gently deflate and provide the user a powerful and relaxing water massage for the duration of the hydrotherapy session. The controls can also be set such that, once a hydrotherapy massage session is complete, the unit 10 will then automatically re=inflate the sleep system 30 to preset pressures Finally, the "Direction" buttons 224 and 226 are used to manually change the direction that the water jet carriage is then currently travelling. This direction is automatically changed when the carriage reaches its end points, either as programmed into the system or as sensed by the magnetic position sensors described above.

The system may be installed in the place of or in a similar fashion as a conventional bathtub or in-home jetted tub. This built-in system can be used in new construction applications or to replace existing in-home tubs. The built-in system incorporates all of the features of the above described system with the addition of two notable exceptions:

1. The fiber formed exterior panels of the system will not be required, as the unit is placed in a permanent location within the home or facility and the exterior will be finished out by the builder or trim carpenter with the bathroom or room's exterior surfaces such as wood, laminates or marble.

2. The built-in system will have the following features:

A. In-line plumbing (connection to hot and cold water lines)

B. Drain connection

C. Automatic fill and drain control.

D. Automatic temperature regulation.

E. Automatic water level detection.

F. 220 pump and wiring.

Although the present invention has been described in terms of the foregoing preferred embodiments, this description has been provided by way of explanation only, and is not intended to be construed as a limitation of the invention. Those skilled in the art will recognize modifications of the various preferred and alternative embodiment, that might accommodate specific environments. Such modifications as to size, and even configuration, where such modifications are merely coincidental do not necessarily depart from the spirit and scope of the invention, the scope of which should be understood instead from the claims appended hereto.

What is claimed is:

1. A system for providing dry hydrotherapy to a human subject in a reclined position, the system comprising:

a liquid container having walls defining an interior and an opening, said container having opposed sides and opposed ends and containing a liquid to establish a liquid level;

a cover positioned and secured to close said opening of said liquid container, said cover having an underside directed towards said interior of said liquid container and an outside surface directed outwards from said interior of said liquid container; and a liquid jet source positioned within said liquid container and oriented to direct liquid at said underside of said cover; said liquid jet source including a jet manifold extending across said container between said sides and having and inlet portion in an end of said jet manifold at one of said sides of said container and at least one discharge orifice above said liquid level so that said liquid passes through air;

a carriage for moving said jet manifold through said container back and forth between said ends of said container wherein movement of said carriage in said container changes a location towards which said liquid is directed on said underside of said cover;

a liquid conduit for conveying liquid from a liquid supply line at another side of said container opposite said one side, said supply line connected to a source of pressurized liquid to said inlet port, said liquid conduit including a flexible hose, a first pivoting coupling connecting one end of said flexible hose to said liquid supply line wherein the combination of said flexible hose and said first and second pivoting couplings allow said carriage to freely move in said container while maintaining fluid communication between said feed line and said jet manifold;

wherein said human subject reclines on said outside surface of said cover and said liquid directed from said orifice at said underside of said cover conveys therapeutic massaging force to said human subject.

2. The system of claim 1 further comprising a heating element in thermal contact with said container for heating said liquid being directed towards said underside of said cover.

3. The system of claim 1 further including a liquid re-circulation system, the re-circulation system comprising a liquid pump having an inlet and an outlet, said outlet in fluid communication with said liquid jet source; and a liquid collector positioned within said liquid container and oriented to receive said liquid after being directed at said underside of said cover and communicating said liquid to said inlet of said liquid pump.

4. The system of claim 1 wherein the pressure of said pressurized liquid is variable and controllable by the user of the system.

5. The system of claim 1 wherein the movement of said carriage is variable and controllable by the user of the system with respect to direction and speed.

6. The system of claim 1 wherein said carriage is moveable on a fixed track, said fixed track includes first and second parallel tubular rails, and said carriage comprises first and second wheel assemblies, said first wheel assembly having wheels positioned on opposing sides of said first rail and said second wheel assembly having wheels positioned on opposing sides of said second rail;

whereby said carriage may move freely along said fixed track but maintains said rails captive within said wheel assemblies.

7. The system of claim 1 wherein said at least one liquid orifice comprises a plurality of slot apertures positioned through a wall of said jet manifold, said slot apertures configured to direct a fan-shaped jet of liquid from said jet manifold directed towards said underside of said cover.

8. The system of claim 1 further including a drive assembly for said carriage, said drive assembly comprising:

a drive cable, said drive cable comprising a closed loop having each end thereof attached to said carriage, said drive cable positioned inside said liquid container; and a drive motor, said drive motor engaging said drive cable and directing a circuitous movement of said drive cable and thereby directing a longitudinal movement of said carriage, said drive motor positioned outside said liquid container and communicating a rotational drive motion to said drive cable by way of a drive shaft extending through an aperture in said wall of said liquid container.

9. The system of claim 1 wherein said cover comprises:

a liquid permeable support layer, said support layer capable of independently supporting a weight of said human subject and being permeable to said liquid directed at said underside of said cover; and a liquid impermeable flexible barrier layer, said barrier layer serving to prevent the passage of said liquid directed at said underside of said cover, through said cover, and thereby to prevent said liquid from contacting said human subject, said barrier layer further transferring the force of said liquid contacting said underside of said cover through to said human subject reclining, said barrier layer positioned between said support layer and said human subject reclining;

wherein said support layer generally bears the weight of said human subject and said barrier layer prevents the passage of liquid through said cover but transmits therapeutic massaging forces through said cover to said human subject.

10. The system of claim 9 wherein said liquid permeable layer comprises open mesh netting secured to a perimeter of said walls of said liquid container.

11. The system of claim 10 wherein said perimeter of said walls of said liquid container comprises a rigid frame and a plurality of attachment posts, and said netting is secured to said attachment posts of said rigid frame.

12. The system of claim 9 wherein said liquid impermeable layer comprises a sheet of waterproof material secured and sealed to a perimeter of said walls of said liquid container.

13. The system of claim 10 wherein said perimeter of said walls of said liquid container comprises a rigid frame and a rim extending there from, and said sheet of waterproof material is secured to said rim.

14. The system of claim 13 wherein said sheet of waterproof material comprises polyurethane.

15. The system of claim 13 further including a press-fit channel clamp sized to fit over said sheet of waterproof material when said sheet of material is placed over said rim, said press-fit channel thereby securing said sheet of waterproof material to said rigid frame.

16. The system of claim 1 further including a support tail positioned to maintain said flexible hose apart from said jet carriage so as to prevent said flexible hoses from impeding the motion of said carriage.

17. The system of claim 1 further including an external shell cover, said shell cover comprising a plurality of removable panels, said panels configured to cover said walls of said liquid container on an outside of said container.

18. The system of claim 17 wherein each of said removable panels comprises:

a rigid core comprising a molded pressed fiber material and having a first side directed outward from said liquid container and a second side directed inward towards said liquid container;

a padding layer generally covering said first side of said rigid core; and a surface layer generally covering said padding layer and stretched around said rigid core and secured to said second side of said rigid core;

wherein a variety of surface layers having different colors and textures may be easily implemented in the construction of said removable panels.

19. The system of claim 1 further including an electronic programmable controller for providing automatic or manual selection of said variable pressure of said pressurized liquid and said movement of said jet manifold with respect to direction and speed.

20. The system as set forth in claim 1 including a mattress on said cover to provide for user sleeping.

21. The system as set forth in claim 20 wherein said mattress is an air chamber that is selectively inflated and deflated.

22. The system as set forth in claim 1 wherein said liquid container is installed into the plumbing and electrical wiring of a building structure.

23. A system for providing dry hydrotherapy to a human subject in a reclined position, the system comprising:

(a) a liquid container having walls defining an interior and an opening, said container having opposed sides and opposed ends and containing a liquid to establish a liquid level;

(b) a cover positioned and secured to close said opening of said liquid container, said cover having an underside directed towards said interior of said liquid container and an outside surface directed outwards from said interior of said liquid container, said cover including:

a liquid permeable support layer, said support layer capable of independently supporting a weight of said human subject and being permeable to said liquid directed at said underside of said cover; and a liquid impermeable flexible barrier layer, said barrier layer serving to prevent the passage of said liquid directed at said underside of said cover, through said cover, and thereby to prevent said liquid from contacting said human subject, said barrier layer further transferring the force of said liquid contacting said underside of said cover through to said human subject reclining, said barrier layer positioned between said support layer and said human subject reclining;

(c) a liquid jet source positioned within said liquid container and oriented to direct liquid at said underside of said cover, said liquid jet source including a jet manifold extending across said container between said sides and having an inlet port in an end of said jet manifold at one of said sides of said container and at least one discharge orifice above said liquid level so that said liquid passes through air; said discharge orifice comprising a plurality of slot apertures, said slot apertures configured to direct a fan-shaped jet of liquid from said liquid jet manifold directed towards said underside of said cover;

a source of pressurized liquid, the pressure of said pressurized liquid being variable and controllable by the user of the system; and a moveable liquid jet manifold, the movement of said moveable liquid jet manifold being variable and controllable by the user of the system with respect to direction and speed, a fixed track comprising a plurality of parallel tubular rails;

a carriage moveable along said fixed track back and forth between said end of said container and;

a drive assembly connected to said carriage, said drive assembly comprising:

a drive cable comprising a closed loop having each end thereof attached to said liquid jet carriage, said drive cable positioned inside said liquid container; and a drive motor engaging said drive cable and directing a circuitous movement of said drive cable and thereby directing a longitudinal movement of said carriage, (c1) a liquid conduit for conveying liquid from a liquid supply line at another side of said container opposite said one side, said supply line connected to a source of pressurized liquid to said inlet port, said liquid conduit including a flexible hose, a first pivoting coupling connecting one end of said flexible hose to said inlet port and a second pivoting coupling connecting an opposite end of said flexible hose to said liquid supply line wherein the combination of said flexible hose and said first and second pivoting couplings allow said carriage to freely move in said container while maintaining fluid communication between said feed line and said jet manifold;

(d) a liquid re-circulation system, the re-circulation system including:

a liquid pump having an inlet and an outlet, said outlet in fluid communication with said liquid conduit; and a liquid collector positioned within said liquid container and oriented to receive said liquid after being directed at said underside of said cover and communicating said liquid to said inlet of said liquid pump; and an electronic programmable controller for providing automatic or manual selection of said variable pressure of said pressurized liquid and said movement of said liquid jet assembly with respect to direction and speed;

wherein said human subject reclines on said outside surface of said cover and said liquid directed at said underside of said cover conveys therapeutic massaging force to said human subject.

24. A system for providing dry hydrotherapy to a human subject in a reclined position, the system comprising:

a liquid container having walls defining an interior and an opening containing a liquid to establish a liquid level;

a cover positioned and secured to close said opening of said liquid container, said cover having an underside directed towards said interior of said liquid container and an outside surface directed outwards from said interior of said liquid container; and a liquid jet source positioned within said liquid container and oriented to direct liquid at said underside of said cover; said liquid jet source including a jet manifold having an inlet port and at least one discharge orifice above said liquid level so that said liquid passes through air;

a carriage for moving said jet manifold through said container wherein movement of said carriage in said container changes a location towards which said liquid is directed on said underside of said cover;

a liquid conduit for conveying liquid from a liquid supply line connected to a source of pressurized liquid to said inlet port, said liquid conduit including a flexible hose, a first pivoting coupling connecting one end of said flexible hose to said inlet port and a second pivoting coupling connecting an opposite end of said flexible hose to said liquid supply line wherein the combination of said flexible hose and said first and second pivoting couplings allow said carriage to freely move in said container while maintaining fluid communication between said feed line and said jet manifold;

wherein said human subject reclines on said outside surface of said cover and said liquid directed from said orifice at said underside of said cover conveys therapeutic massaging force to said human subject;

an external shell cover, said shell cover comprising a plurality of removable panels, said panels configured to cover said walls of said liquid container on an outside of said container, each of said removable panels comprises;

a rigid core comprising a molded pressed fiber material and having a first side directed outward from said liquid container and a second side directed inward towards said liquid container;

a padding layer generally covering said first side of said rigid core; and a surface layer generally covering said padding layer and stretched around said rigid core and secured to said second side of said rigid core;

wherein a variety of surface layers having different colors and textures may be easily implemented in the construction of said removable panels.

* * * * *